US006032853A

United States Patent [19]

Chevalier

[11] Patent Number: 6,032,853

[45] Date of Patent: Mar. 7, 2000

[54] CONTAINER SUPPLIED IN FLAT CONDITION, AND SET INTO SHAPE IN TWO DISTINCT PHASES AND HAVING EXTENDED ADHESIVE EFFECT

[76] Inventor: Pierre Andre Marc Chevalier, 31, Boulevard d'Auteuil, F-92100 Boulogne, France

[21] Appl. No.: 09/029,698

[22] PCT Filed: Aug. 8, 1996

[86] PCT No.: PCT/FR96/01268

§ 371 Date: Apr. 24, 1998

§ 102(e) Date: Apr. 24, 1998

[87] PCT Pub. No.: WO97/10137

PCT Pub. Date: Mar. 20, 1997

[30] Foreign Application Priority Data

Sep. 15, 1995 [FR] France ..... 95 10873

[51] Int. Cl.[7] ..... B65D 5/24; B65D 5/64

[52] U.S. Cl. ..... 229/125.37; 229/145; 229/148; 229/149; 229/150; 229/163; 229/182; 229/189

[58] Field of Search ..... 229/125.37, 125.39, 229/145, 149, 150, 148, 163, 182, 186, 189, 228, 240

[56] References Cited

U.S. PATENT DOCUMENTS

| | | | |
|---|---|---|---|
| 1,813,298 | 7/1931 | Klin | 229/149 |
| 2,157,686 | 5/1939 | Ballard | 229/186 |
| 2,206,304 | 7/1940 | Ringler | 229/186 |
| 2,545,802 | 3/1951 | Bergstein | 229/186 |
| 3,091,381 | 5/1963 | Conescu | 229/186 |
| 3,137,434 | 6/1964 | Berg | 229/186 |
| 3,478,949 | 11/1969 | Richgels | 229/146 |
| 3,655,115 | 4/1972 | Manizza | 229/145 |
| 4,750,609 | 6/1988 | Felis . | |
| 5,503,325 | 4/1996 | Nelson et al. | 229/148 |

FOREIGN PATENT DOCUMENTS

| | | | |
|---|---|---|---|
| 560223 | 9/1993 | European Pat. Off. | 229/186 |
| 2656594 | 7/1991 | France . | |

OTHER PUBLICATIONS

Intl. Publication No. WO 97/10137, Mar. 20, 1997 w/ Copy of Intl. Search Report by the EPO (Mld. Mar. 17, 1997).

*Primary Examiner*—Gary E. Elkins
*Attorney, Agent, or Firm*—Notaro & Michalos P.C.

[57] ABSTRACT

The container made of cardboard or similar material intended to the packaging of objects is formed from a blank which is comprised at least one flat rough form and which presents, when in flat condition, different components: a polygonal planar base intended to receive the objects to be packaged and walls adjacent to the base and intended to be straightened up with respect to said base in order to set the container in volume, a so-called "closure " panel being optionnally provided in order to close the container once the objects to be packaged have been placed on the base. It is characterized in that the blank is associated to at least one distinct element (120-121, 122-123, 124-125, 126-127) which is intended to be set in a definitive active position wherein, on the one hand the base (106) is completely cleared and accessible to objects to be laid thereon and, on the other hand, it joins and holds out of their original plane at least two components (107-108-109-110) of said container which are adjacent to the base (106), having a surface smaller than that of said base (106), and others than the optionnal closure panel (140), the distinct element (120-121, 122-123, 124-125, 126-127) placed flat directly against at least one of the components (107-108) of the container, the extended adhesive effect (131) being provided in order to keep in a definitive position the raised up components (107-108-109-110) and the distinct element or elements (120-121, 122-123, 124-125, 126-127).

32 Claims, 12 Drawing Sheets

CONTAINER SUPPLIED IN FLAT CONDITION, AND SET INTO SHAPE IN TWO DISTINCT PHASES AND HAVING EXTENDED ADHESIVE EFFECT

FIELD OF THE INVENTION

Besides the stiff containers and the ones used in industry for automatic packaging, containers can be divided into two main categories:

those displayed in volume to the user those requiring to be assembled to use them.

The present invention relates to the second category.

It aims to remedy a well-known defect coming from the fact that a container which is not completely closed is often unstable, forcing the user to do backward and hazardous handling as he should hold into volume at least one part of the container and fill the objects to be packed at the same time.

The user would thus need three hands: two to hold the container and one to handle the objects. To avoid that, accessories external to the container itself have to be used such as: staples, adhesive tape, glue etc., everything only professional users commonly have at their disposal, they who also have the use of a place adapted to packaging tasks as well as all the required accessories and equipment.

This is obviously not the case of casual users who have to more or less improvise the actual packaging steps, besides the assembling of a container delivered down flat.

Of course, it is sometimes possible to maintain the container with one hand and to fill the objects with the other hand. But this "more or less" is very inadequate for a container designed to be presented to users for any possible packaging cases whereas it is industrially manufactured in series.

But it is exactly what happens nowadays.

The folding containers sold in post offices can be given as examples. They are delivered down flat to the user who has to set sides or sections (which is equivalent) upright, maintain them and at the same time fill the objects to be packed as the container only becomes stable once it is definitively closed.

It can be understood that if the user proceeds in the post-office itself, he does not have the use of any convenience.

If he proceeds at home, he can use a clear table, adhesive tape, string or staples but all this proves the container is not convenient as it is not self-sufficient.

This invention mainly remedies that drawback by providing users, private individuals or professionals, with a container including all that is necessary to its practical use, which makes any accessory useless so that it is stable and steady before the user has to fill the objects to be packed.

This invention will become apparent from the following detailed description of the preferred embodiment when read in light of the accompanying drawings. Of course, the description and drawings are given as reference and non restrictive information only.

BRIEF DESCRIPTION OF THE DRAWINGS

FIG. 1 is a schematic planar view of a blank in accordance with the invention, designed to make a container without any lid.

FIG. 2 is a schematic perspective view of a container without any lid, in the process of being assembled, coming from the folding of the blank of FIG. 1.

FIG. 3 is a schematic planar view of an outline in accordance with the invention designed to constitute a blank and then a container without any lid FIG. 4 is a schematic planar view of a ready for use blank obtained from the outline of FIG. 3.

FIG. 5 is a schematic perspective view of a container without any lid, in the process of being assembled, coming from the folding of the blank of FIG. 4.

FIG. 6 is a schematic perspective view of the container of FIG. 5, during the final stage of assembling.

FIG. 7 is a schematic planar view of an outline in accordance with the invention, designed to constitute a blank and then a container without any lid.

FIG. 8 is a schematic planar view of a ready for use blank, coming from the outline of FIG. 7.

FIG. 9 is a schematic perspective view of a container without any lid in the process of being assembled, coming from the partial folding of the blank of FIG. 8.

FIG. 10 is a schematic view showing detail of the container of FIG. 9.

FIG. 11 is a schematic perspective view of the container of FIGS. 9 and 10 during the final stage of closing.

FIG. 12 is a schematic perspective elevational view showing the container of FIG. 11.

FIG. 13 is a schematic perspective elevational view showing the container of FIG. 11 during a closing stage following the one of FIG. 12.

FIG. 14 is a schematic front view of the container of FIGS. 12 and 13.

FIG. 15 is a schematic side view of the container of FIGS. 12 and 13.

FIG. 16 is a schematic perspective view of the container of FIG. 9 to 15 after complete closing.

FIG. 17 is a schematic front view of a variant of embodiment of the container of the previous figures where the closing of the said container is designed to be at the lower part of one of the wall of the container.

FIG. 18 is a schematic side view of the container of FIG. 17 once it is completely closed.

FIG. 19 is a schematic perspective view of the container of FIG. 17 and 18 after complete closing.

FIG. 20 is a schematic planar view of an outline in accordance with the invention designed to constitute a blank then a container with a lid and side protection edges.

FIG. 21 is a schematic planar view of a ready for use blank obtained from the outline of FIG. 20.

FIG. 22 is a schematic perspective view of a container in the process of being assembled, obtained from the blank of FIG. 21.

FIGS. 23 and 24 are two partial schematic views showing two stages of the assembling of the container of FIG. 22.

FIGS. 25 and 26 are two partial schematic views showing variants of the embodiment of the container of FIGS. 22 to 24.

FIG. 27 is a schematic planar view of a blank in accordance with the invention similar to the one of FIG. 21 and corresponding to a variant of embodiment.

FIG. 28 is a partial schematic view of a container obtained from the blank of FIG. 27.

FIG. 29 is a schematic perspective view of the container of FIG. 28 in the process of being completely closed.

FIG. 30 is a schematic elevational view of the container obtained from the blank of FIG. 27.

FIG. 31 is a schematic front view of the container of FIG. 30.

FIG. 32 is a schematic planar view of an outline in accordance with the invention, designed to constitute a blank and then a container with a lid and side protection edges, and showing a variant of embodiment.

FIG. 33 is a schematic planar view of a ready for use blank obtained from the outline of FIG. 32.

FIG. 34 is a schematic perspective view of a container in the process of being assembled from the blank of FIG. 33.

FIGS. 35 and 36 are two partial schematic views showing two stages of the assembling of the container of FIG. 34.

FIGS. 37 and 38 are two partial schematic cross sectional views of FIGS. 34 to 38, respectively before and after complete closing.

FIGS. 39 and 40 are two schematic views showing two variants of the blocking of side flaps applied as reinforcement to the outside of the side walls of the container of FIGS. 7 to 38.

FIGS. 41 to 48 are schematic views of an embodiment of the invention consisting of a container with a covering lid.

FIGS. 49 to 51 are schematic views of a blank in accordance with the invention showing segments of adhesive placed lengthwise and not crosswise any more, and more precisely:

FIG. 49 shows segments of adhesive placed lengthwise on two distinct elements for the initial partial formation of the container and on the fixing section for the closing of the container.

FIG. 50 is a view similar to FIG. 49 showing the same segments of adhesive completed by segments of adhesive placed on the side walls.

FIG. 51 is a view similar to FIGS. 49 and 50 showing the same segments of adhesive completed by segments of adhesive placed on four distinct elements.

FIG. 54 is a schematic perspective view of a distinct element in accordance with the invention, according to the embodiment allowing the said distinct element separated from the corresponding blank to bear adhesive with long-term effect placed lengthwise.

FIG. 55 is a schematic perspective view of a stock of distinct elements of FIG. 54, as it can be presented in actual practice.

FIG. 56 is a schematic perspective view of a distinct element similar to the one of FIG. 54 but bearing adhesive with long term effect placed crosswise.

FIG. 57 is a schematic planar view of an outline in accordance with the invention designed to constitute a blank, then a container with a variable height, according to the objects to be packed.

FIG. 58 is a schematic planar view of a ready for use blank, obtained from the outline of FIG. 57.

FIG. 59 is a schematic view of the blank of FIG. 58 and of the distinct element of FIG. 54 during the formation of the container.

FIG. 60 is a view similar to the one of FIG. 59 showing the same blank that the one of FIG. 58 but with a bigger distinct element, adapted to the packing of small objects.

FIG. 61 is a schematic view showing the blank of FIG. 58 during the immovability stage of side walls by means of this distinct element.

FIG. 62 is a schematic view similar to FIG. 61 showing the container and the objects to be packed partly covered by crosswise sections extending the sides.

FIGS. 63 and 64 are two schematic perspective views showing respectively the bottom wall and the top wall of the container of FIGS. 58 to 62 after complete closing.

FIG. 65 is a schematic planar view of a blank in accordance with the invention including two parallel strips linked together.

FIGS. 66 to 67 show two intermediate situations while the blank is set to be used by relative pivoting of the two strips.

* WARNING: NO FIG. 68 (translator's comment)

Figures 65, 66, 67, 68, 69, 70, 71, 72, 73, 74:
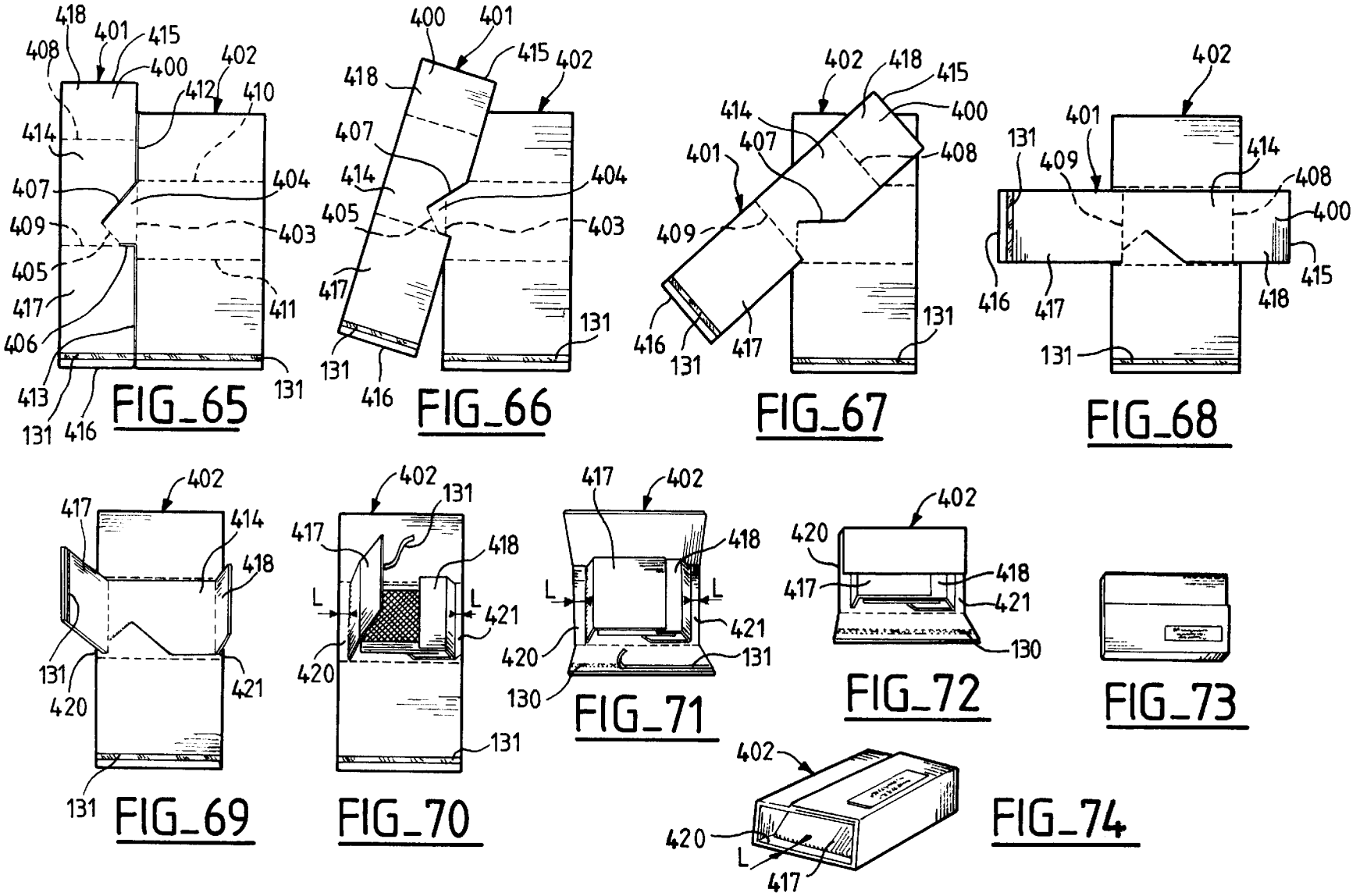

FIG. 69 is a schematic perspective view of the blank of FIG. 68 after the side sections are partially set up right.

FIG. 70 is a schematic perspective view of the blank of FIG. 69 after the objects to be packed are placed and one of the side section is closed.

FIG. 71 is a schematic perspective view of the blank of FIG. 70 after the two side sections are closed, the distinct element is fixed, and the two ends of a strip which has to wrap the closed sections and close the container are partly set up right.

FIG. 72 is a schematic perspective view of the blank of FIG. 71 after one of the end of the strip is closed.

FIG. 73 is a schematic perspective view of the container completely closed with the adhesive with long term effect and coming from the blank of FIGS. 65 to 72.

FIG. 74 is a schematic perspective view of the container of FIG. 73 and showing one of its small walls.

DETAILED DESCRIPTION OF THE PREFERRED EMBODIMENTS

The word "adhesive" is used herein as a reference of a substance which retains all of its properties from a relatively long time, especially when it is protected by a ribbon.

The goal is actually to postpone the use of the said adhesive after it is placed in the production stage.

Such an adhesive is known in itself and it is sometimes defined by being qualified of adhesive with "a permanent set time" which brings an "self adhesive surface".

The word adhesive must not be confused with the word "glue" which concerns a substance which must be used without delay, immediately after it is placed, for an ultimate fixing before it hardens by drying, polymerization, evaporation of solvents and/or cooling. When glue is used for the containers production, it definitely glues together two parts of the blank from which the container is set into shape by the user who then does not have access to the glue, which is a means of irreversible fixing.

The fixing made by fixed means or means leaving indelible marks if it is removed, which is the case for staples for instance, can also be seen as an irreversible fixing.

The adhesive can be of any known type, in particular of the double side tape, often referred to by the phrase "adhesive transfer tape" or, for instance, according to the arrangements of the European patent 431 144 registered under the applicant's name.

In the following description, the invention is supposed to be applied to cardboard but of course it can be used with any other material adapted to the use for which the containers are intended.

As it was explained at the beginning of the present description, this invention relates to the packaging of objects in containers produced and then delivered in flat blank form, having, depending on the circumstances, one or several thickness, the user (and not the manufacturer) setting the blank into shape to make a container.

All this means the container in accordance with the invention can be presented in several shapes according to the stage of its cycle which is looked at:

a cut outline a flat blank already fit with adhesive with long term effect a blank already fit with adhesive with long term effect and already partly folded onto itself a blank already fit with adhesive with long term effect and already partly folded onto itself, some part being fixed in an irreversible way (with glue, staples or similar)

a container partly or completely set into shape, empty or in the process of being packed a closed container.

Figure 1:
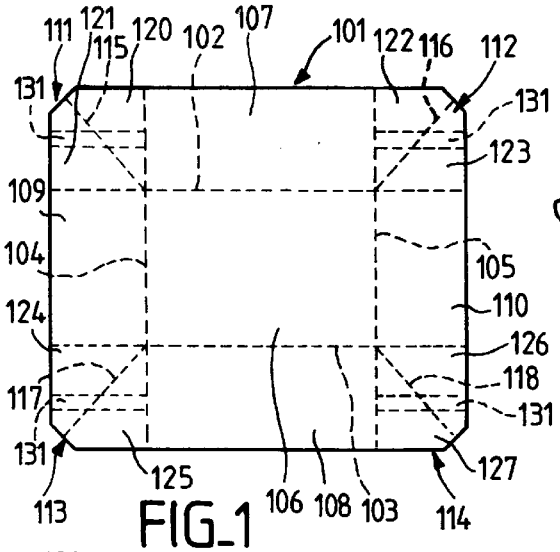
FIGS. 1 to 49 illustrate various embodiments of the invention for a container with pre-determined dimensions like a container or a box. More particularly.

Referring to FIG. 1, a blank 101 made of a cut outline marked with four pre-folding lines forming a pair of crosses 102, 103 and 104, 105 which delimit a base (or bottom wall 106, two walls called "cross walls" 107 and 108 as well as two walls called "side walls" 109 and 110 can be seen.

It is understood that after the walls 107, 108, 109 and 110 are set upright according to the lines 102, 103, 104 and 105 in planes perpendicular to the one of base 106, a bowl or a container is formed or having a base 106 and four outside walls 107,108, 109 and 110, the walls 107 and 108 being called "cross walls" and the walls 109 and 110 being called "side walls".

Besides those five necessary components, theoretically sufficient to constitute a container, the pre-cut lines 102, 103, 104 and 105 delimit four distinct elements 111, 112, 113 and 114 quadrangular in shape and exactly fitting in the outline of the blank 101 and which, if they were not kept for reasons which will arise from the description below, would constitute off-cuts to eliminate fruitlessly.

Four lines of pre folding 115, 116, 117 and 118 placed diagonally delimit for each distinct element two triangular flaps 120-121, 122-123, 124-125 and 126-127.

On the side opposed to the one visible on FIG. 1 of the blank 101, adhesive with long term effect 130 is placed on the four distinct elements 111, 112, 113 and 114 in four lines parallel two by two, the adhesive being covered with a removable protection tape 131.

Naturally, each times adhesive with a long term effect 130 is mentioned, especially when it is placed in lines, it must be understood that the adhesive 130 may be placed in more or less large areas, continuous or dotted and so, in continuous or discontinuous straight, curved or broken lines.

It can be noticed that the lines of adhesive are approximately half way up the distinct elements and thus cross the oblique pre-folding lines 115, 116, 117 and 118 which affords a major interest as it will be explained later.

With the embodiment which has just been described, it can be seen that the outline, after manufacturing, is delimited by its outer outline cut in a sheet and by the pre-folding lines 102, 103, 104 and 105 and 115, 116, 117 and 118.

When the outline is fitted with an adhesive with long term effect 130 covered with a protection tape 131, there is then a complete blank which integrates, through manufacturing, all the elements necessary to the creation of a container by a user.

The blank of FIG. 1 is then ready to be marketed and for this purpose the manufacturing is followed by a grouping of several blanks 101, a possible packaging, a stocking and a delivery to the customers, which mean the end-user.

The user receives one or several blanks, possibly stores them and then takes them one by one to create as many containers as he wishes.

To do that, he removes the protection tape 131 corresponding to the triangular flaps 124-125 and 126-127, he sets the two side walls 109 and 110 upright according to the arrows F1 and then sets the cross wall 108 upright according to the arrows F2.

Figure 2:
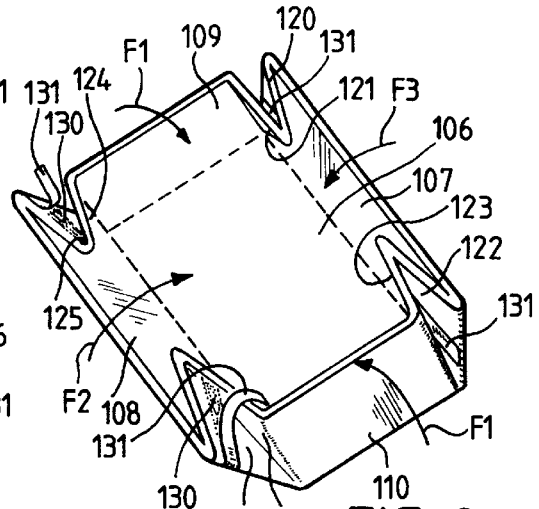

Consequently, the distinct elements 113 and 114 automatically fold in bellows according to the lines 103-104-117 and 103-105-118, as it can be seen in FIG. 2.

In actual practice, the distinct elements 113 and 114 being immovably attached at the same time to a side wall and the cross wall 108, the setting up right of the walls 109 and 110 starts the setting upright of the cross wall 108 so that the user only perfects the setting upright of the wall 108 by gripping and holding the wall 108 and the triangular flaps 124 and 126 tight.

Due to the oblique pre-folding lines 117 and 118, the adhesive 130 finds itself split into two segments for each of the distinct elements 113 and 114: one segment is on the triangular flap 124-126 and the other on the triangular flap 125-127.

The very favorable consequence of the folding at 45° of these triangular flaps according to the oblique lines 117 and 118 is that after complete folding, the two segments of a same distinct element 113-114 find themselves opposite each other while being perpendicular.

The segment of the flap 124-126 applies vertically (which means perpendicularly to the pre-folding line 103) against the opposite triangular flap 125-127, while the segment of the flap 125-127 applies horizontally (which means parallel to the pre-folding line 103) against the opposite triangular flap 124-126 (see FIG. 2).

The user completes the assembling by gripping the wall 108 and the triangular flaps 124 and 126 between two fingers.

Those very simple gestures do not require any accessory external to the blank delivered by the manufacturer.

At this stage, the user formed only a part of the complete container: the base 106, a cross wall 108 and two side walls 109 and 110. And yet this part is already stable in itself when it is laid down flat by the base (or bottom) 106 on any plane support like a table.

The user can then use his both hands to fill the objects to be packed on base 106.

In the same way, after he filled the objects, he retains the use of his both hands to complete the container.

The completion consists in removing the protection tape 131 from the distinct elements 111 and 112 and then in gripping the cross wall 107 and the triangular flaps 121 and 123 between two fingers after the wall 107 is completely set upright according to the arrows F3.

The explanations given above concerning the distinct elements 113 and 114 apply for the distinct elements 111 and 112, so that after the wall 107 is completely set upright and the distinct elements 111 and 112 are folded down flat, the triangular flaps are fixed two by two in their final position: the flaps 120 and 122 against the flaps 121 and 123.

The user can then use a complete container without any lid of a type known under several names: tray, container, bowl, crate, basket and so on.

According to the nature of the objects to be packed, they can be left exposed or be protected by a protection cap or a lid.

For instance, some fruits are only protected by a simple light paper sheet or a plastic film, sometimes pierced to allow the ventilation of the content whereas others have to be shut up by means of a stiff lid as it will be described later. The container of FIGS. 1 and 2 is very easy and only needs for its production elementary and cheap operations.

On the other hand, the blank 101, once it is delivered, is relatively bulky as it shows only one thickness without superposition, and consequently, has a rather important width, equal to the sum of the width of wall 109, base 106 and wall 110.

The embodiment which will be described now, in relation to FIGS. 3 to 6, differs from the previous one by an additional link, made during the production, between the cross walls and the distinct elements, which, besides, has the advantage of making the delivered blank narrower.

Figure 3:
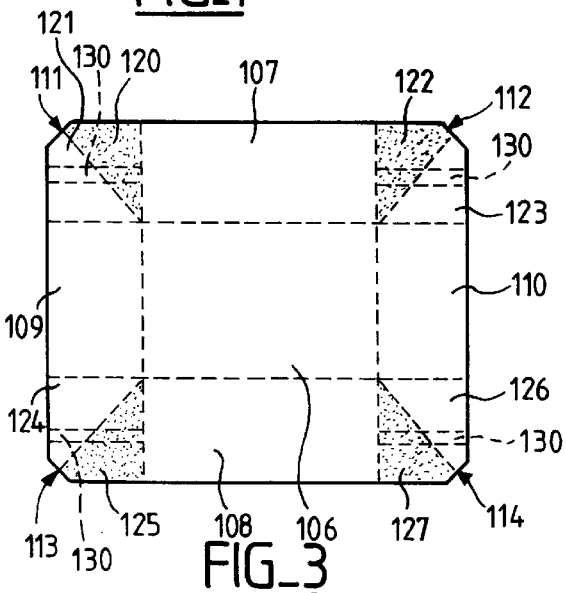

In FIG. 3, an outline corresponding exactly in shape and dimension to the bank in FIG. 1 can be seen, as one and the other are designed to obtain a container with the same conception and the same capacity.

The triangular flaps 120, 122, 125 and 127 receive, during the production, glue represented by a dotted pattern and which, here, is provided to be on the whole surface of the triangular flap but which, of course, could also be placed in one or several limited or in line deposits.

As it was explained earlier, that glue must not be confused with the adhesive with long term effect 130. It must be used right after it is placed at its right location.

Here, the glue must join in an irreversible way each of the two cross walls 107 and 108 with the adjacent triangular flaps, that is the wall 107 with the flaps 120 and 122 and the wall 108 with the flaps 125 and 127. All this is obtained during the production by folding over the cross wall 107, 108 and the base 106, the group wall 109 and distinct elements 11 and 113 along the pre-folding line 104 on the one hand, and the group wall 110 and distinct elements 112 and 114 along the pre-folding line 105 (see FIG. 4) on the other hand.

Figure 4:
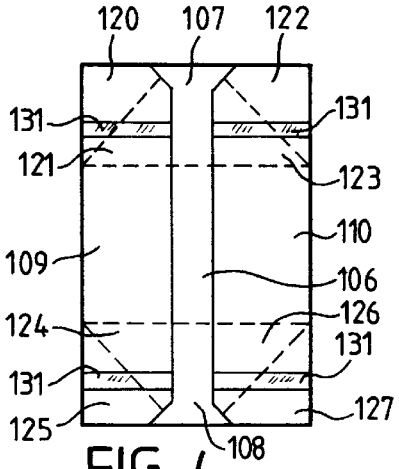

The outline of FIG. 3 is thus just an intermediate between its cutting up and its setting into the shape of a blank ready to be delivered, as it is represented in FIG. 4.

That blank is narrower than the one in FIG. 1 which means less bulky and if it shows a double thickness in relation to the fact that two side parts are superposed on the central part, it is not a significant disadvantage compared to the advantages it shows for its delivery and its assembling by the user.

Indeed, thanks to the fact that the triangular flaps are fixed on the side walls, the setting upright of the walls and the automatic folding of the distinct elements are easier.

Figure 5:
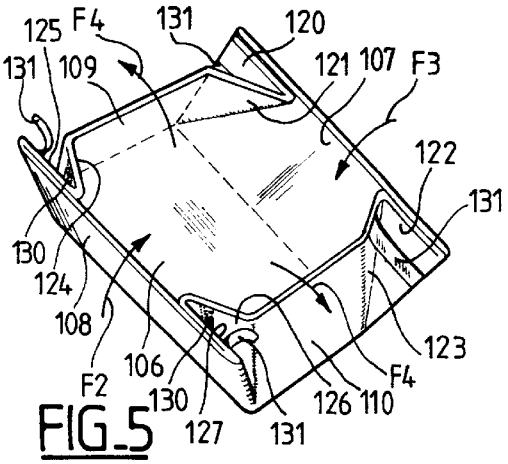

FIG. 5 illustrates the putting into volume of the blank which here starts not by setting the side walls 109, 110 and the cross wall 108 upright but by lifting the side walls 109 and 110 according to the arrows F4.

The distinct elements 111, 112, 113 and 114 being immovably attached to the adjacent cross and side walls and the triangular flaps 120, 112, 125 and 127 being fixed (from the production) to the cross walls 107 and 108, lifting the side walls 109 and 110 has the effect of automatically setting the cross walls upright and of forcing the distinct elements to fold along the oblique pre-folding lines 115, 116, 117 and 118.

The user removes the protection tape 131 from the distinct components 113 and 114, before or after he lifted the side walls 109 and 110.

It is the position thus reached which is shown in FIG. 5 on which the triangular flaps 120, 122, 125 and 127 are distinctly applied against the cross walls 107 and 108, whereas in the equivalent position (FIG. 2) of the previous embodiment, the two triangular flaps of each distinct element 111, 112, 113 and 114 are still spread in bellows.

It is understood that the fixing of the triangular flaps to the cross walls brings another advantage as the triangular flaps cannot move away from the cross wall to which they are secured whereas with the embodiment of FIGS. 1 and 2 they are only secured thanks to the geometry of the pieces involved, geometry which opposes to their moving away if the walls are set upright and immobilized, which is obtained with the adhesive 130.

Figure 6:
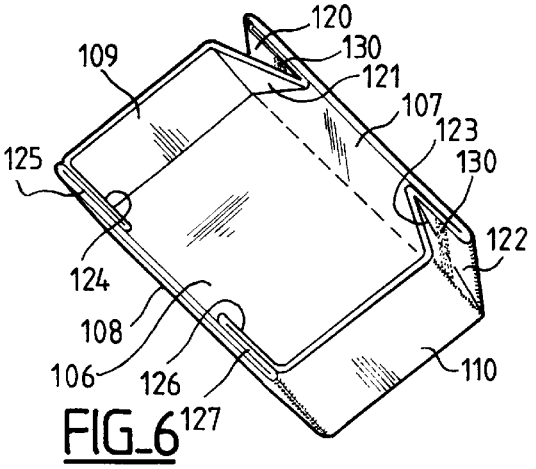

The position of the container after the side walls 109, 110 and the cross wall 108 are set upright and fixed can be seen in FIG. 6.

With the wall 108, the flaps 124,125 and 126,127 form a fixed and undissociable whole, the flaps 125 and 127 are being glued to the wall 108 and the flaps 124 and 126 are being fixed to the flaps 125 and 127 with the adhesive 130.

The cross wall 107 is represented in the position it has once it has been partly set upright automatically as a result from the traction exerted by the distinct elements 111 and 112 themselves pulled by the side walls 109 and 110 lifted by the user.

The protection tape has been removed and all the user has to do is to grip the wall 107 and the triangular flaps 121 and 123 to benefit from a completed container.

The objects to be packed can be placed on the base 106 indiscriminately before or after the wall 107 and the flaps 121 and 123 are fixed.

The container in accordance with the invention can have an integrated lid as it will be described now and illustrated in FIGS. 7 to 19.

In these figures, the same parts bear the same references than the previous ones and their description as well as their use will be repeated only if it is useful for the understanding of the drawings.

Figure 7:
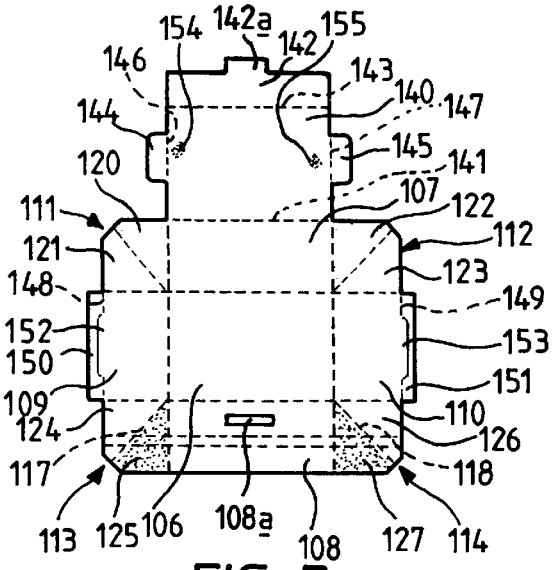

FIG. 7 represents an outline similar to the one of FIG. 3. The cross wall 107 is immovably attached to a closing panel 140 by a pre-folding line 141 and the panel 140 is itself immovably attached to a section called "fixing section" 142 by a pre-folding line 143.

The closing panel 140 shows two flaps called "blocking flaps" 144 and 145, differentiated from the panel 140 by pre-folding lines 146 and 147.

The side walls 109 and 110 are immovably attached to each other by pre-folding lines 148 and 149 of flaps 150 and 151 marked by pre-cut lines 152 and 153.

The triangular flaps 120, 122, 125 and 127 receive glue as it was already indicated in FIG. 3. Adhesive with long term effect 130 covered with a protection tape 131 is placed on the hidden side of the outline of FIG. 7 and spread crosswise in one line from one edge to the other of the outline crossing the oblique pre-folding lines 117 and 118.

Moreover, two dots of glue 154 and 155 are placed on the closing panel 140 opposite the flaps 144 and 145. As with the previous embodiment, the glue must irreversibly join each of the two cross walls 107 and 108 with the adjacent triangular flaps which means the wall 107 with the flaps 120 and 122 and the wall 108 with the flaps 125 and 127 which is obtained during the production by folding over the cross walls 107, 108 and the base 106, the group wall 109 and distinct elements 111 and 113 along the pre-folding line 104 on the one hand, and the group wall 110 and distinct elements 112 and 114 along the pre-folding line 105 (FIG. 8) on the other hand.

While doing that, the blocking flaps 144 and 145 are also folded along the pre-folding lines 146 and 147 and they fix on the panel 140 inside its outline thanks to the glue dots 154 and 155.

Figure 8:
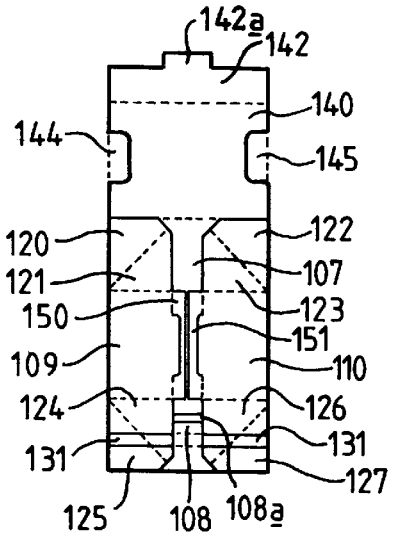

The outline of FIG. 7 is then nothing but an intermediate between its cutting up and its putting into a blank form ready to be delivered as it is represented in FIG. 8.

During the use of the blank of FIG. 8, the user does the same operations than those described with the previous embodiment in relation to FIGS. 3 to 6 and, in addition, he sets the blocking flaps 144 and 145 upright, which is possible as the glue dots 154 and 155 are spread on a very small surface and/or made of a substance having on purpose a low coefficient of adhesion.

The blocking flaps 144 and 145 are simply unstuck and they are only put in active position at the moment of the closing of the container which is described below.

Figure 9:
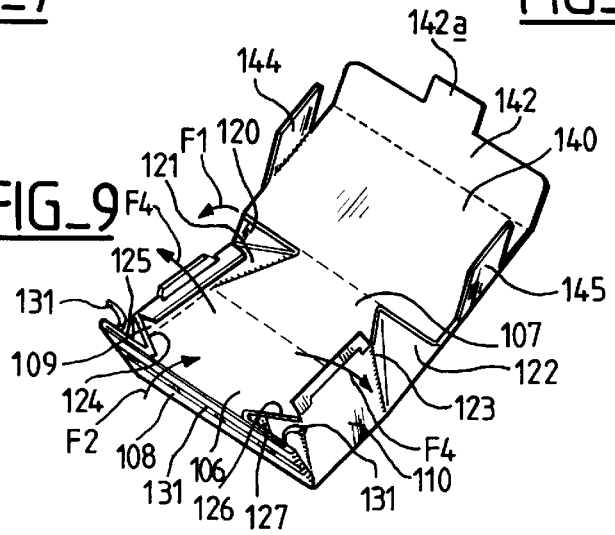

The user lifts the side walls 109 and 110 according to the arrows F4 which puts the blank in the situation mentioned in FIG. 9.

He removes the protection tape 131 from the end of the said tape situated near the edges of the triangular flaps 124 and 126 the tape remaining in its place on its whole length situated on the external side of the cross wall 108 thanks to the fact that during the production, the tape is cut crosswise to itself in a perpendicular manner to the pre-folding lines 104 and 105 which form the demarcation between the wall 108 and the triangular flaps 125 on the one hand and 127 on the other hand.

Figure 10:
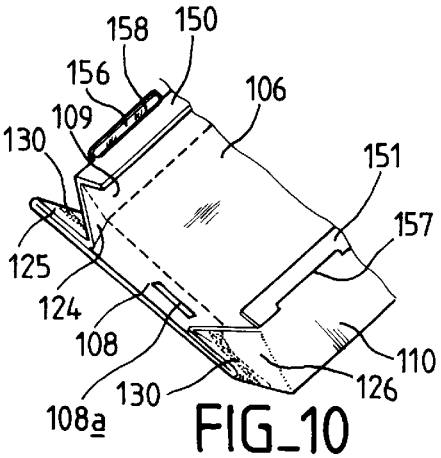

Thus, the user can fix with the uncovered adhesive 130 the flaps 124 and 126 to the flaps 125 and 127 glued to the wall 108 during the production, operation mentioned in FIG. 10.

As it was described before, that single operation allows to make the part of the container formed by the base 106, the cross wall 108 and the side walls 109 and 110 perfectly stable and steady by means of the distinct elements 113 and 114.

The user can then place the objects to be packed on the base 106 by using his both hands.

It can be noticed that unlike the previous embodiment there is no adhesive 130 on the triangular flaps 120-121 and 122-123 because it is not essential as it will be seen below, but of course it is possible to adopt the same solution that the one of FIGS. 1 to 6 if one wants to completely finish the 106-107-108-109-110 container apart from its closing by the panel 140 and the fixing section 142.

Once the objects to be packed are filled, the user pulls down the flaps 150 and 151 towards the inside which clears the parts of the cardboard cut by the pre-cut lines 152 and 153, the said parts delimiting two ribs 156 and 157 prominent over the flaps 150 and 151, because of those parts remaining the continuation of the side walls 109 and 110 instead of folding with the flaps 150 and 151.

Pulling down the flaps 150 and 151 discloses two slots 158 and 159 the width of which matches the thickness of the cardboard so that a flap 144-145 can penetrate it.

The ribs 156 and 157 can be suppressed if they are not used, for instance to cooperate with the closing panel 140. Here they are useful during the production as they create the slots 158 and 159 needed, while avoiding the delicate operation of the removing and the elimination of the cardboard cut on the four sides of each slot.

Figure 11:
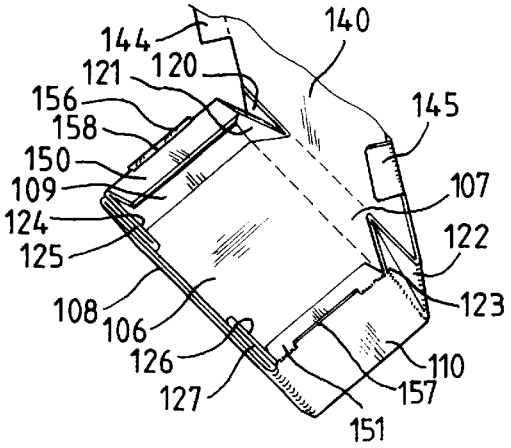
Figure 12:
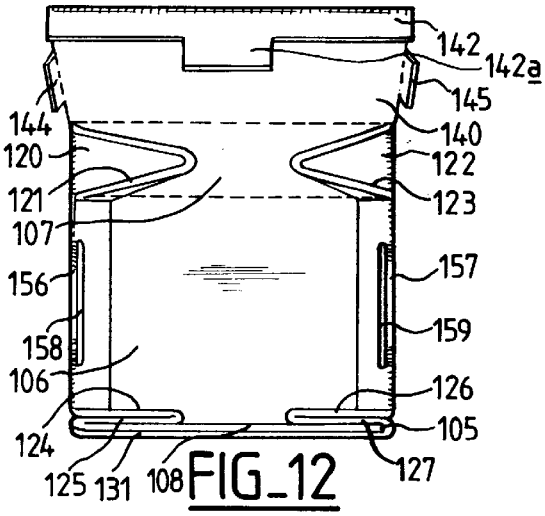

After he pulled down the flaps 150 and 151, the user sets the closing panel 140 upright which, attached to the wall 107, acts on the latter by setting it upright, the distinct elements 111 and 112 folding automatically in bellows as it was indicated before which is represented in FIGS. 11 and 12.

Figure 13:
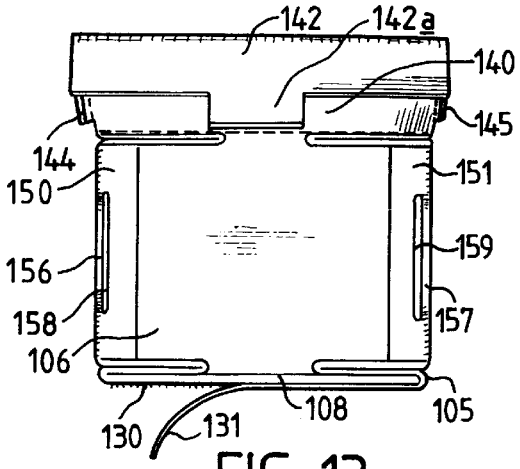
Figure 14:
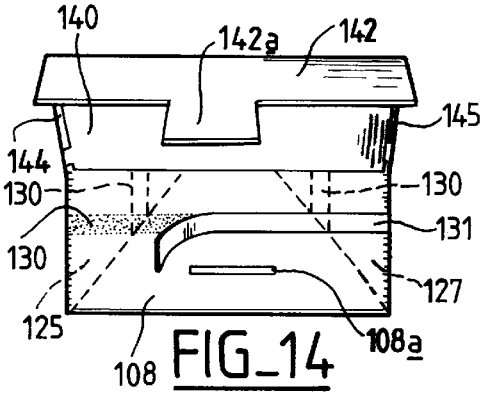

Then, if he did not do it before, the user removes the protection tape 131 still in place outside the wall 108 and then pulls down the closing panel 140 and inserts the blocking flaps 144 and 145 into the corresponding slots 158 and 159 (FIGS. 13 and 14).

Figure 15:
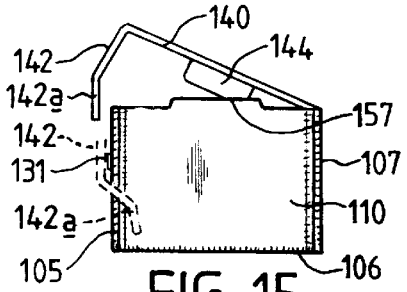

Then the user perfects the closing of the container by applying the fixing section 142 against the cross wall 108 to which it permanently fix with the adhesive 130 which was disclosed when the tape 131 was removed (FIG. 15).

The completed container constitutes a box the production of which is easy and cheap as it only requires processes and means accessible to the one skilled in the art.

The blanks are delivered down flat and take up very little volume for their shipment and storage.

The setting into shape of a blank in order to assemble it into a container is over simplified in relation to the similar known models and it needs no assembly or closing accessory.

It then makes a box particularly well adapted to the end-user and notably for postal dispatch.

The presence of flaps 144 and 145 cancels between the top side walls 109-110 and the closing panel 140 any space through which a thin object like an envelop, a postcard, a sheet or any similar item could, either voluntarily or accidentally go from the inside to the outside or inversely from the outside to the inside.

This warranties both the integrity of the content and the safety of the documents and mail in general, likely to mix with a closed box in accordance with the invention.

Further, the closed box is impregnable, even through fraudulent practices, for when the adhesive 130 of the closing section 142 has been revealed and then applied against the wall 108, it is impossible to open the box and to have any access to the content other than by destroying an external part, which immediately discloses the fraud and prevents it to be secretly done.

The experience showed that an attempt to unglue the fixing section 142, even with caution, from a corrugated cardboard box results in the tearing up of paper making the cardboard front bearing the adhesive and to disclose the internal grooves, even beyond the primarily covered area, with the result that the opening (to the attempt to open) is immediately visible.

In relation to FIGS. 7 to 16, an embodiment according to which adhesive with long term effect is applied on a single cross line and how important the advantage for simplicity and efficiency was reflected by the setting of the said adhesive 130 through two distinct elements 113 and 114 roughly at mid-height in order to cross the pre-folding lines 117 and 118 has been described.

But this simplicity leads to the necessity of forecasting the adhesive 130 of the wall 108 at the same height of the completed box as the one necessary to the intersection of the pre-folding lines 117 and 118.

Consequently, the height of the fixing section 142 must only be sufficient to cover the wall 108 up to the adhesive 130 level and for safety reasons, slightly below.

The more the adhesive 130 is placed down, next to the base 106, the higher the fixing section 142 must be but the more its fixing thanks to the adhesive is strong.

As a matter of fact, the fixing section 142, the closing panel 140 and even the side wall 107 are submitted to a strength which tends to the return of these components to their original location as they are brought to the final position by forcing the cardboard along the pre-folding lines 102, 141 and 143.

This strength is translated by a permanent solicitation of tearing up the fixing section 142, hence its disconnection with the wall 108 and if it should occur, it is the entire box which would be dislocated and all its qualities ruined.

It is then necessary, not only that the adhesive with long term effect 130 be of a very high quality but also that the fixing section 142 be retained as far as possible from the pre-folding line 141, i.e. as near as possible from the edge of the base 106, in order to oppose a lever-arm as long as possible to the tearing strength.

Figure 17:
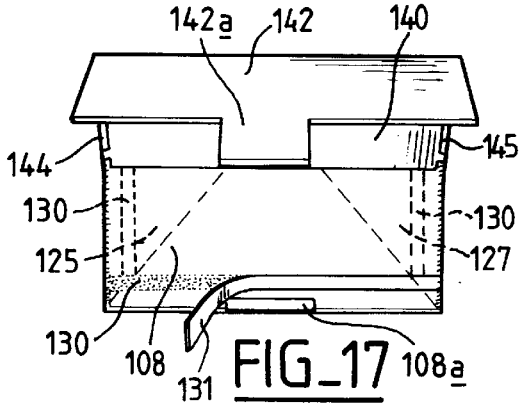
Figure 18:
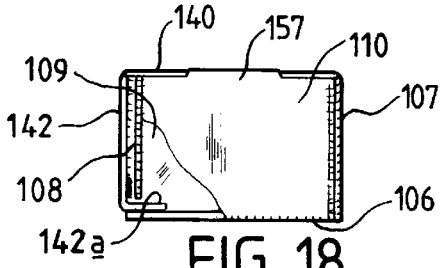
Figure 16:
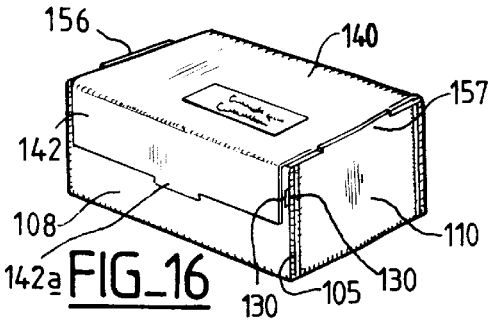
Figure 19:
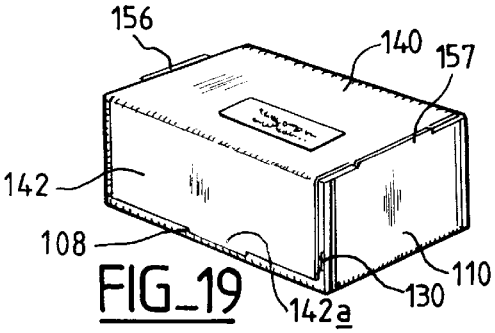

The adhesive 130 must then be placed on the wall 108 lower than the mid-height of the triangular flaps 124-125 and 126-127, which is represented in FIGS. 17 to 19.

Here is only represented a single line of adhesive 130 (FIG. 17) for it is a convenient solution because it prevents to overload the drawing and it enables to show with dotted lines the location of the adhesive 130 on the triangular flaps into two perpendicular segments.

But two lines of adhesive 130 on the wall 108 could also be forecasted: one at the same level than mid-height of triangular flaps, as it is shown in FIGS. 7 to 16, and another one lower, as it is shown in FIGS. 7 to 19, all the more if a less reliable adhesive is used.

The more the adhesive 130 is next to the base 106, the stronger is the fixing of the fixing section 142.

As a matter of fact, the pressure action exerted by the user during the closing of the box creates a correlative reaction of the wall 108 and, as the said wall 108 is flexible, its resistance towards deformation depends on the rigidity of the structure, the said rigidity is maximum on the pre-folding line 103 and decreases when it goes away due to the fact that the line determines two perpendicular planes (base 106 and wall 108) and equals to a stiffening rib.

With adhesive 130 located near the base 106, the closing of the box is then secured even if the user, during this step, exerts an average pressure on the section 142.

Further, while putting adhesive 130 and its protection tape according to a single cross line, across distinct elements 113 and 114 and the lowest possible position of the box, the crossing of the two segments of adhesive 130 on the triangular flaps is made in a way that the horizontal segment is short but the vertical segment very long (FIG. 17), which is a very good solution for it provides for an excellent fixing.

In order to increase the reliability of the fixing of section 142, another solution can be adopted consisting in forecasting a reinforcement tongue 142*a* integral of the free edge of the said section 142 on the one hand, and a slot 108*a* in the wall 108 on the other hand.

With the arrangements of FIGS. 7 to 16, the slot 108*a* is then below the adhesive 130 and over the lower edge of the cross wall 108, due to the fact that the fixing section 142 is less high than the cross wall 108.

It is necessary for this slot 108*a* to be under the adhesive 130 but its best location is just above the base 106, i.e. the safety system is better adapted to the embodiment of FIGS. 17 to 19 which forecasts that the fixing section 142 has the same height than the cross wall 108.

One skilled in the art knows how to make the tongue 142*a* and the corresponding slot 108*a* according to different variants which shall not be described here.

All the containers which have just been described have a common feature in that their side walls are directly connected to the base 106 according to right angles.

This invention enables its application to containers which present side edges the utility of which is very important for they insure an excellent protection of the container itself and of the objects to be packed against chocks, falls and other violent accidental efforts that any container can inevitably undergo during its handling and transportation.

Now a container of this type in relation to FIGS. 20 to 40 is going to be described.

In these Figures, the same parts bear the same references as on the previous Figures and their description as well their usage will only be repeated if it is useful for the understanding of the drawings.

Figure 20:
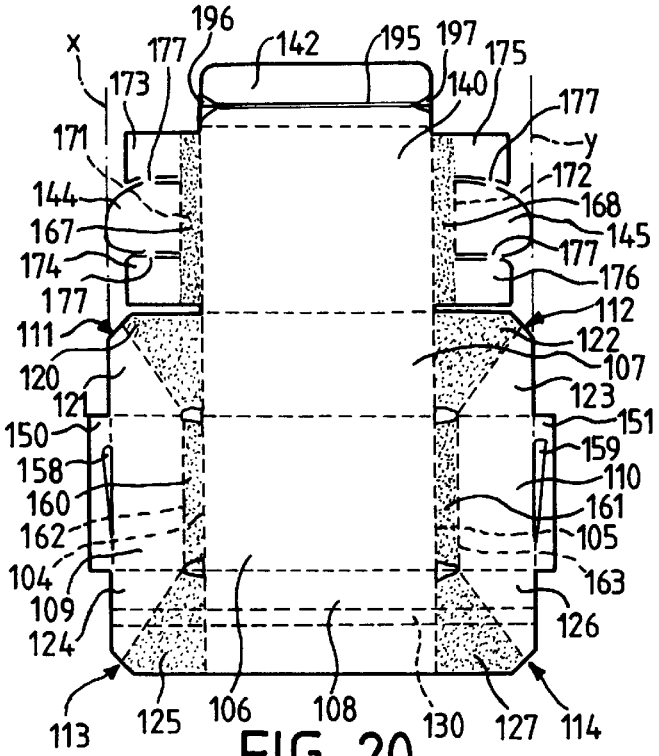

The outline of FIG. 20 receives glue not only on the triangular flaps 120,122, 125 and 127 but also on two side strips located beyond the side edges of base 106, which enlarges this blank on the base of the side walls 109 and 110 as well as along the triangular flaps 120, 122, 125 and 127.

The oblique lines 115, 116, 117 and 118 are similar to those of the previous embodiments, i.e. they always lead to the bottom of side walls 109 and 110.

Pre-folding lines 162 and 163 fringe these strips 160 and 161 and make a separation between the side walls 109-110 and the said strips 160-161.

The said lines 162 and 163 then end in the oblique lines 115, 116, 117 and 118.

As with an embodiment described above, the ready to use blank is made, during its production stage, by folding over the side walls 107, 108 and the base 106, the set made of the side wall 109, the distinct elements 111 and 113 and the side strip 160 along the pre-folding line 104 on the one hand, and the set made of the side wall 110, the distinct elements 112 and 114 and the side strip 161 along the pre-folding line 105 (FIG. 21) on the other hand.

Thus are created after folding during the production stage two side edges 165 and 166 which are very useful in order to absorb any shocks received by the container because they are located in front of the side walls 109 and 110.

The side walls 109 and 110 being back, the side walls 107 and 108 extend up to the external limit of the edges 165 and 166, thanks to their enlargement by the strips 160 and 161.

The side walls 109 and 110 are thus protected on three sides.

It is then more advantageous to complete this protection with the fourth side, i.e. by the closing panel 140.

By so doing, if the blocking flaps 144 and 145 were, as with the previous embodiment, located at the edge of the closing panel 140, they would not be in straight line any longer with the slots 158 and 159.

Figure 21:
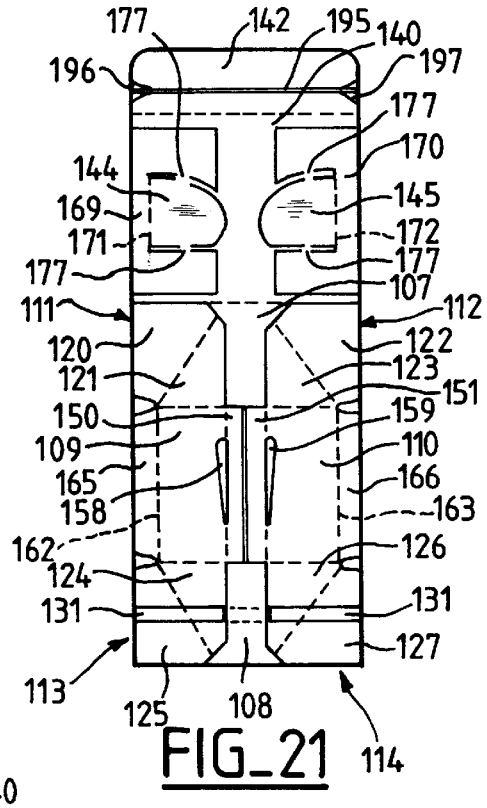

For all these reasons, the closing panel 140 is enlarged by two strips 167 and 168 which are glued against it during the folding step of the outline of FIG. 20 in order to obtain the blank in FIG. 21.

The result is the creation after folding, during the production step, of two side edges 169 and 170 which complete the protection of the back side walls 109 and 110.

The flaps 144 and 145 are connected to these edges 169 and 170 by pre-folding lines 171 and 172.

With the above example, the cardboard of the available outline is used from one side to the other of the panel 140 to generate, without any waste, reinforcements 173-174 and 175-176 on each side of the flap 144 and the flap 145 in a single part with the strips 167 and 168.

The strips 167 and 168, just as the reinforcements 173 to 176, can of course be irreversibly secured to the panel 140 otherwise than by glue laid as shown in the drawing of FIG. 20 (notably by staples), or glue can be laid otherwise than according to (full and continuous surfaces), for instance: dots, spots, lines etc.

The blocking flaps 144 and 145 should not be irreversibly secured as they should be set upright outside their plane.

For so doing, it can be forecasted to lay a dot of glue of the same quality than the one of the strips 167 and 168 because the surface glued is so small that it can be easily torn up without any damage.

But "bridges" or "fixing points" can also be created during the outline cutting stage, i.e. small uncut fractions of cardboard 177 during the cutting of the lines which give the outline of the flaps 144 and 145 and isolate them from the reinforcements 173, 174, 175 and 176 and joining the two edges of the slots coming from this cut.

When the user wishes to set these blocking flaps 144 and 145 upright, he just has to do a minor effort for the bridges 177 are very small and fragile and break very easily while disclosing the flaps 144 and 145.

After having set the blocking flaps 144 and 145 upright, the user sets the side walls 109 and 110 upright according to the arrows F4 and goes on the setting into shape as shown above: removal of the tape 131 on the distinct elements 113 and 114, setting upright of the side wall 108 and fixing by the adhesive with long term effect 130.

The user then engages the flaps 144 and 145 in the slots 158 and 159 and here the said flaps 144 and 145 have been given such a length that much before flanging the closing panel 140, the free end of the flaps 144 and 145 reaches the entry of the slots 158 and 159, in a way that the user can see both flaps at the same time and can easily guide them to partly engage them. While flanging the panel 140, the user is insured that the flaps 144 and 145 will enter the slots 158 and 159 according to the arrows F5 (FIG. 29) up to the closing panel 140 applies in abutment against the flaps 150 and 151.

The observation of the outline of FIG. 20 shows that the blocking flaps 144 and 145 can be given the same width than the walls 108 and 109, without any waste of cardboard, as the mixtilinear lines x and y show.

After setting into shape, the flaps 144 and 145 thus extend on the whole height of the side walls 109 and 110 and take support on the base 106.

Figure 22:
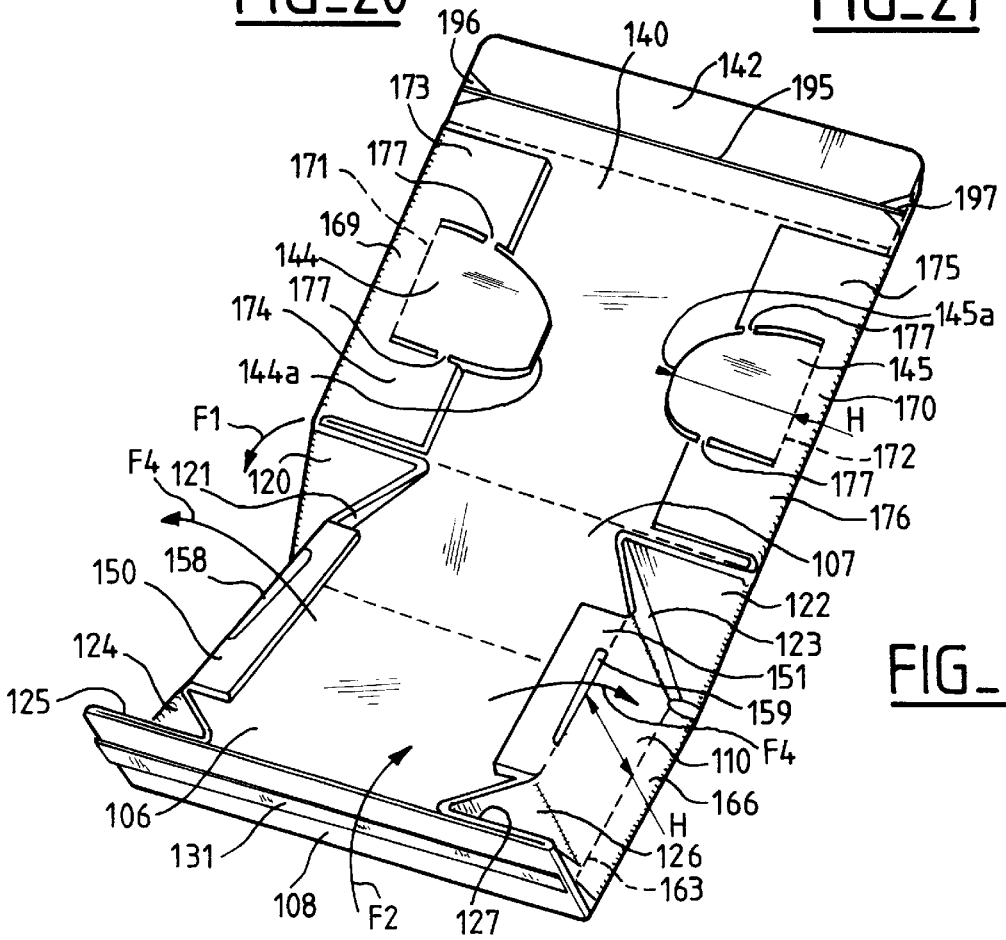

In FIG. 22, it can be seen that the height H of the flaps 144 and 145 is really equal to the height H of the walls 108 and 109 and consequently make efficient reinforcements, in increasing the resistance to crusting of the completed box.

For the support of the flaps 144 and 145 on the base 106 to be efficient, their free end 144*a* and 145*a* must be flat for it extends according to a straight line.

As it has been seen earlier, when the distinct elements 111 and 112 bear no adhesive, which is the case here, the triangular flaps 121 and 123 are rather turned aside from the next triangular flaps 120 and 122, which leaves the pre-folding line 141 backwards according to which the closing panel 140 joints the cross wall 107.

While bringing the panel 140 upfront, the user does not necessarily tight the triangular flaps 120 and 122 towards the triangular flaps 121 and 123, with the result that the free ends 144*a* and 145*a* of the flaps 144 and 145 do not necessarily present themselves at the middle of the length of the slots 158 and 159.

Moreover, the inclination of the said flaps 144 and 145 against the vertical axis of the walls 109 and 110, connected to the solicitation of the cardboard which tends to bring the wall 107 and thus the closing panel 140 backwards, has for natural effect that the first contact between the flaps 144 and 145 and the flanges 150 and 151 is made by the back edge of the flaps with the end of the slots 158 and 159 the nearest to the wall 107 and the panel 140.

Figures 23, 24:
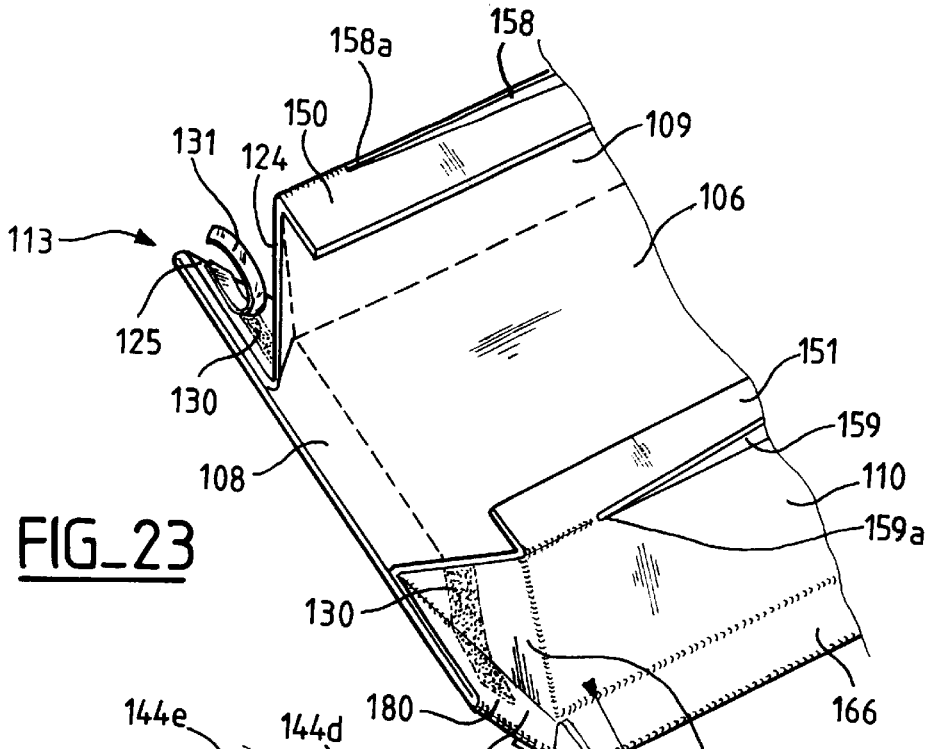
Figure 29:
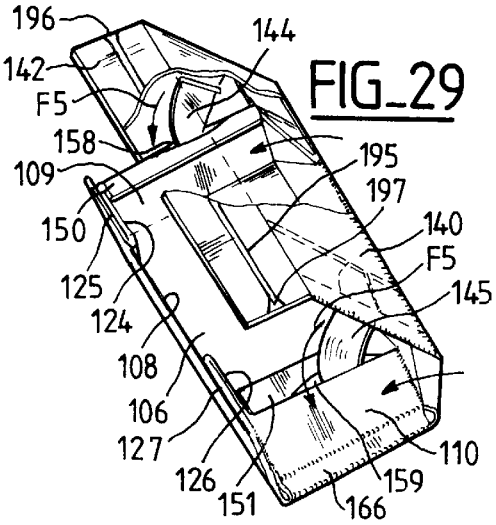
Figure 30:
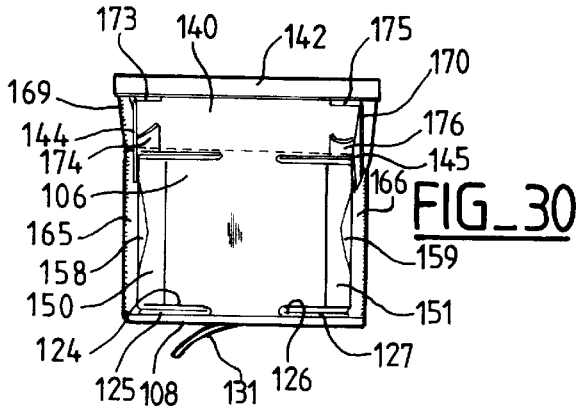
Figure 31:
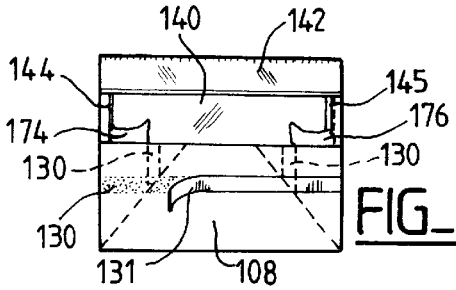

In FIGS. 24 and 29, the back edges 144*b* and 145*b* of the flaps 144 and 145 are straight and against the "front" end 158*a* and 159*a* of the slots 158 and 159, and the opposite "rear" end 158*b* and 159*b* is larger than the front end 158*a*–159*a*.

In fact, the experiment proves that according to the proportions of the box, the contact between the flaps 144 and 145 and the flanges 150 and 151 can also happen around the middle of the slots 158 and 159.

In actual practice, there is a choice between slots with parallel edges and slots with non parallel edges, either the slots are larger at one of their end than the other, or they are larger in their central part.

This last solution is visibly represented in FIGS. 25 to 30.

As regards the straightness of the edges 144*b* and 145*b*, it enables to exert a mechanical lever effect during the flanging of the closing panel 140:

When the box is totally closed, the longitudinal axis of the flaps 144 and 145 is parallel to the vertical edges of the walls and perpendicular to the plane of the base 106, their free ends 144*a* and 145*a* laying on the base 106.

Their back edges 144*b* and 145*b* are thus also vertical, their down parts 144*c* and 145*c* being perpendicular to the rear ends 158*b* and 159*b*.

But the flanging of the panel 140 is not done through a straight line but according to a curve which results from the pivoting of the wall 107 around the pre-folding line 102 and the pivoting of the panel 140 around the pre-folding line 141.

Thanks to the support of the edges 144*b* and 145*b* against the edges of the ends 158*b* and 159*b* of the slots 158 and 159, the simple action of the panel 140 over the objects to be packed automatically creates the pivoting of the wall 107 and the folding of the triangular flaps 121 and 123 because the edges 144*b* and 145*b* exert a pressure on the ends 158*b* and 159*b* for the flaps 144 and 145 cannot be lowered without simultaneously provoke any point of their edges 144*b* and 145*b* to stay in contact with the ends 158*b* and 159*b*.

At the end of the movement, the high parts 144*d* and 145*d* of the said edges 144*b* and 145*b* are thus located at the ends 158*b* and 159*b* of the slots 158 and 159.

The front edges 144*e* and 145*e* are advantageously curved in order to easily penetrate any near the front ends 158*a* and 159*a*.

The existence of edges 165 and 166 results in the fact that the triangular flaps 120-122 and 125-127 have a disclosed part which vertically extends the corresponding edge 165-166, which is very beneficial.

The triangular flaps 125 and 127 receive adhesive with long term effect 130 on their whole length, as if the said adhesive 130, as it has been described with embodiment of FIGS. 7 to 19 was available, the removal of the protection tape 131 at that location would leave the adhesive 130 disclosed, available for all kinds of dust and impurities and presenting the danger of retaining the objects next to the closed box without even evoke the drawback for the user to involuntarily put his fingers on the adhesive.

In order to prevent that disadvantage, it is important not to put adhesive on the external part of the triangular flaps 125 and 127, which is practically automatic if the adhesive is placed by small extensions: spots, dots etc.

When the adhesive is chosen to be placed in continuous line on the whole width of the outline, as it has been described above, there is a neutral area created, i.e. without any available adhesive, on the triangular flaps 125 and 127, according to a length roughly equal to the width L of the edges 165 and 166.

Figure 26:
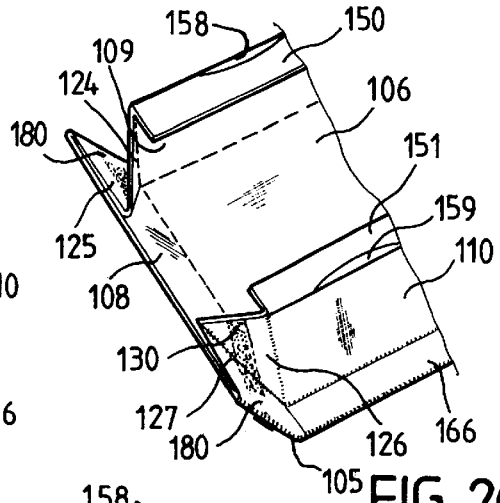

According to a first solution, the adhesive 130 is prevented to be applied at the wished location for the neutral area 180, as it can be seen in FIGS. 23 and 26.

This solution is easy, especially when the adhesive is applied according to the arrangements described in the European patent 431.144 registered under the name of the applicant.

On the contrary, it is more difficult not to put any tape 131 because when working continuously, it means to cut the tape 131 at the beginning of the area 180 and to start again its setting just after the area 180.

Figure 25:
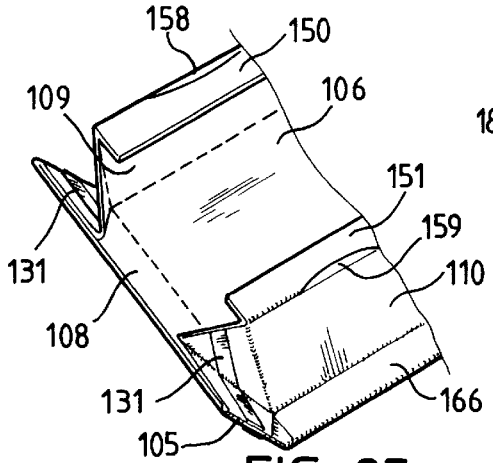

It is then advised to cover the neutral area 180 with the tape 131 in order to benefit from its continuous setting, which is represented in FIG. 25.

It is recalled that this tape 131 is cut perpendicular to the vertical edges 104 and 104 which separate the wall 108 and the triangular flaps 125 and 127, this cut being very easily obtained by a simple blade after setting the said tape 131.

Figure 27:
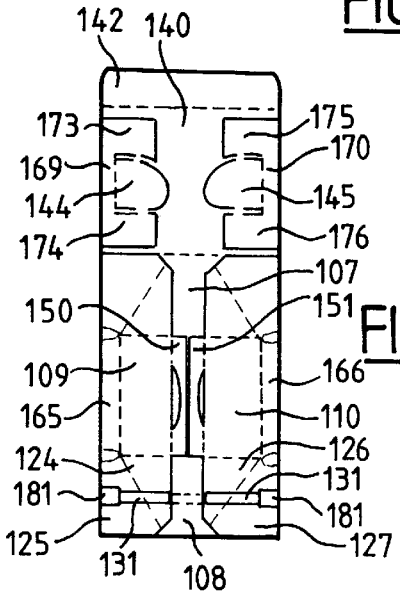
Figure 28:
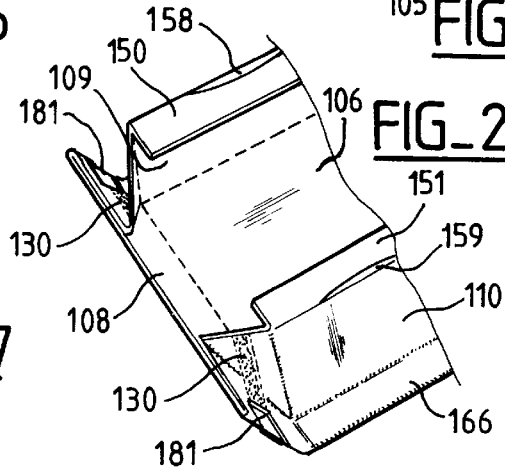

Another solution consists in laying the adhesive 130 and its protection tape 131 normally and then remove them locally, which is represented in FIGS. 27 and 28. This removal consists in cutting the cardboard of the outline but obviously after the setting of the adhesive and the protection tape 131, according to a window 181 which makes the neutral area wished.

The embodiments described above always forecast the direct holding of the triangular flaps 125 and 127 (as well as eventually the triangular flaps 120 and 122 against the wall 108 (as well as eventually against the wall 107) by glue and the holding of the corresponding triangular flaps 121-123 and 124-126 by adhesive with long term effect 130 which join them without any intermediate.

The embodiment of FIGS. 32 to 40 forecasts the holding of the triangular flaps and consequently of the distinct elements 113 and 114 (as well as eventually 111 and 112) as a whole by various means, in a way that the distinct elements are directly maintained.

In these figures, the same parts bear the same references than the previous ones and their description as well as their use will be repeated only if it is useful for the understanding of the drawings.

Figure 32:
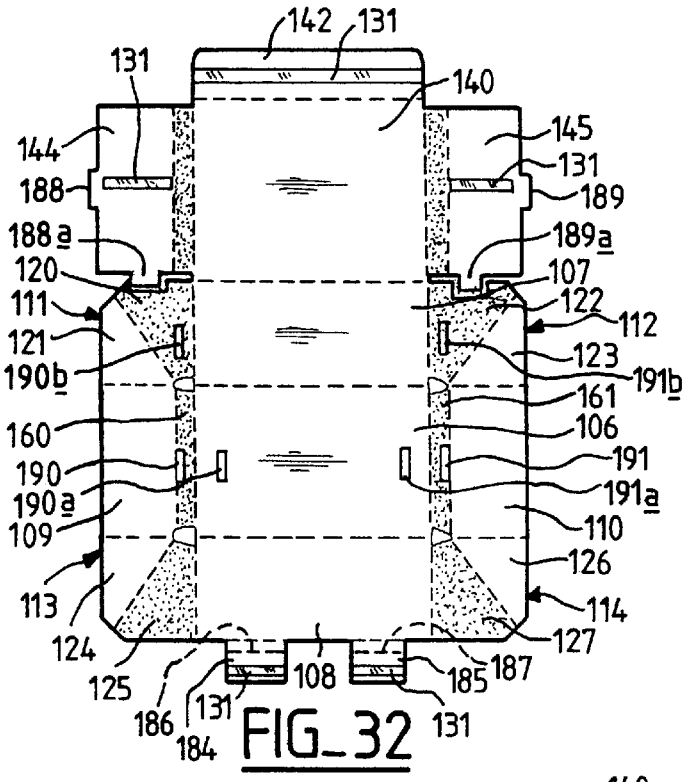

The outline of FIG. 32 shows two "blocking" sections 184 and 185 of the cross wall 108 by pre-folding lines 186 and 187 and each bearing a segment of adhesive 130 and of protection tape 131.

The triangular flaps 125 and 127 do not near any adhesive 130.

Figure 33:
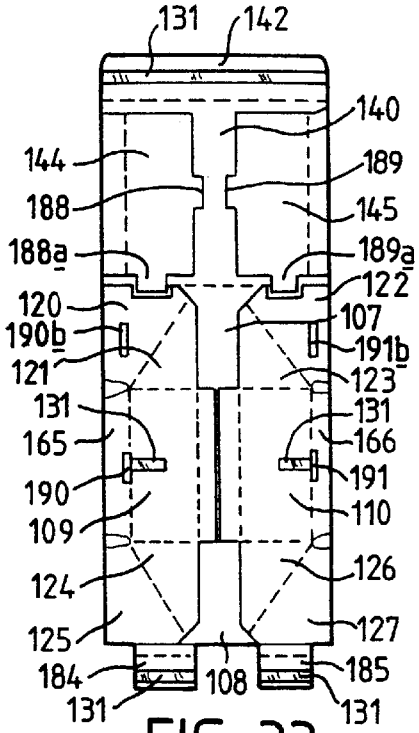
Figure 34:
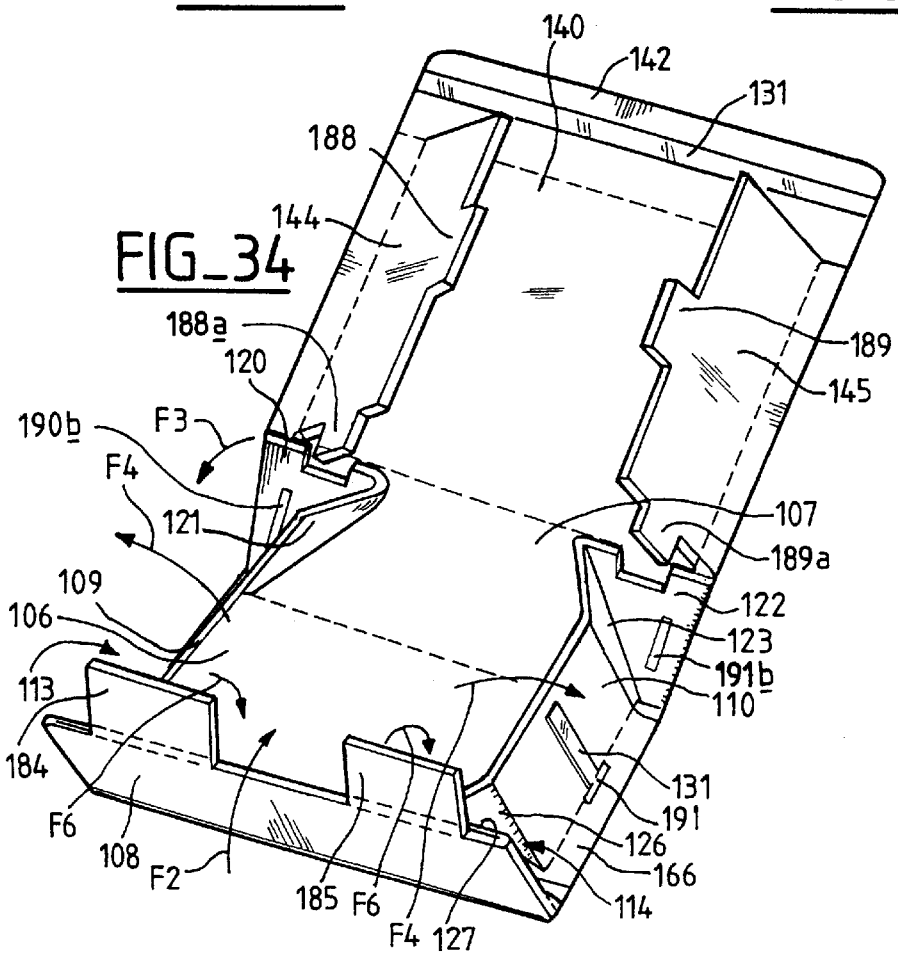
Figure 35:
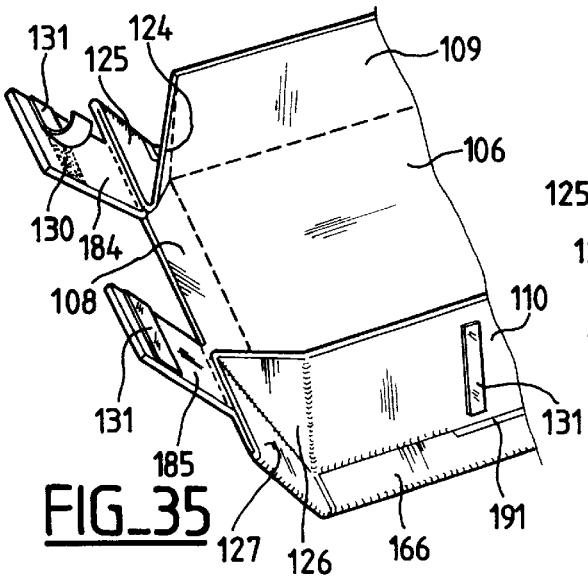
Figure 36:
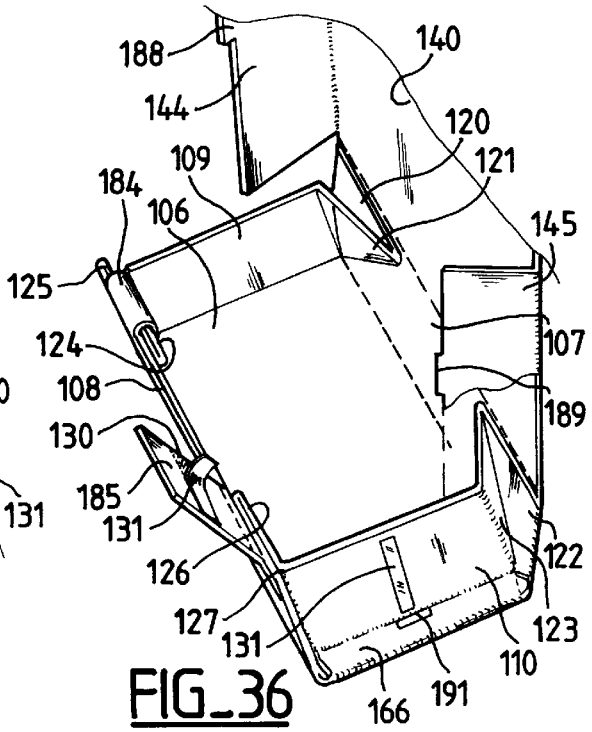
Figure 37:
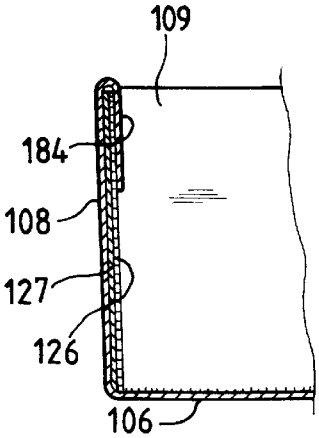

On the ready to use blank of FIG. 33, the blocking sections 184 and 185 stay in their position and then exceeds the outline of the blank.

As well as for the blocking flaps 144 and 145 of FIGS. 7 and 8, the sections 184 and 185 can be folded inside the outline of the blank by flapping against the internal side of the cross wall 108 in order to be protected from any accidental hooking.

During the setting into shape of the container (FIG. 34), the user lifts the side walls 109 and 110 according to arrows F4 then sets upright the cross wall 108 according to arrow F2.

By so doing, the distinct elements 113 and 114 are folded, their triangular flaps 124-125 and 126-127 fold one against the other and against the wall 108.

The user flaps the sections 184 and 185 inside according to arrows F6 after having removed the protection tape 131 of each of both sections (preferably before lifting the side walls 109 and 110).

By fixing against the internal side of the triangular flaps 124 and 126 by the adhesive 130, the sections 184 and 185 block the whole set of distinct elements 113 and 114 against the cross wall 108, which is the purpose.

This embodiment thus shows a variant regarding the blocking flaps 144 and 145, the said variant being of course able to be used independently from the embodiment chosen for the other components of the container.

Here, the said flaps 144 and 145 must no longer be placed inside the side walls 109 and 110 but outside.

For that, they have here nearly the same surface than the said walls and show tongues 188-189 aimed to penetrate the slots 190 and 191 created in the cardboard thickness and forming the strips 160 and 161.

It can be seen herein that there are no flaps 150 and 151 any longer for they are useless.

After the setting into shape and the assembling of the side walls 109, 110 and the cross wall 108, the user removes the protection tape 131 located on the fixing section 142, sets the blocking flaps 144 and 145 upright then brings the closing panel upfront while holding the flaps 144 and 145 outside and against the walls 109 and 110.

By putting the fixing section 142 against the wall 108, the user simultaneously tightens the distinct elements 111 and 112 and the tongues 188 and 189 are automatically in front of the slots 190 and 191.

The flaps 144 and 145 are held in a position where they double the resistance of the side walls 109 and 110.

At the location where the slots 190 and 191 must be, there are two thickness of cardboard: the one of the side edge 165-166 and the one of the base 106.

In order to block the tongue 188-189, it may be sufficient to create the slot 190-191 by a single cutting of the blank perpendicular to the lateral strip 160-161, the opposite side of which makes the side edge 165-166.

Figure 38:
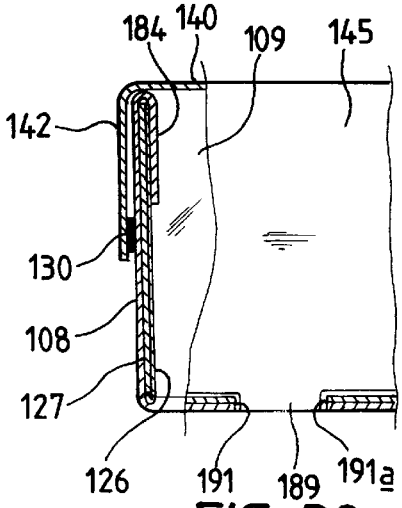

But, for more safety, the tongue 188-189 can be given a height equal to the one of the two thickness of cardboard and make a second slot 190*a* and 191*a* respectively in the actual bottom 106 (FIG. 32) with the result that after its setting, the tongue 188-189 crosses both the side edge 165-166 and the bottom 106 (FIG. 38).

Another solution consists in forecasting two tongues for each side of the container and not a single tongue 188-189. Two variants of this solution are shown in FIGS. 39 and 40 which each only represents a single side of the container, with the result that we are going to describe for this single side is obviously the symmetric equivalent of the opposite invisible side, whether for the outline, the blank or the real container.

Figure 39:
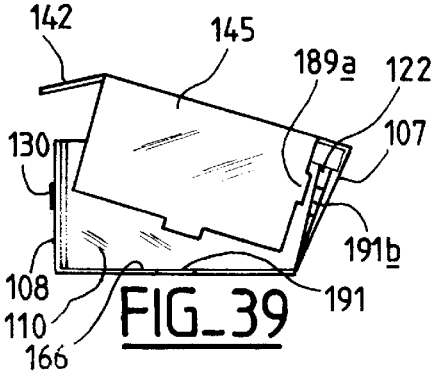
Figure 40:
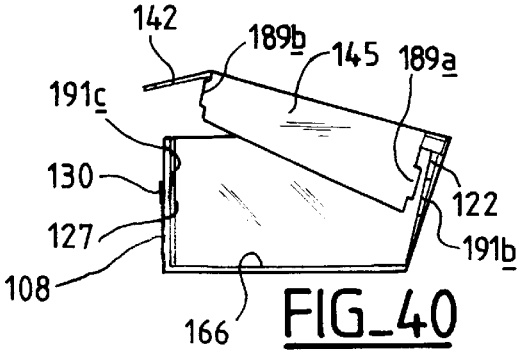

In FIG. 39, the flap 145 placed outside the side wall 110 and having a lower tongue 189 can be seen again. It is forecasted herein a second tongue 189A of the side of the flap 145 which must be perpendicular to the bottom 106 of the upright container.

This tongue 189*a* is blocked by the edges of a slot 191*b* made in the triangular flap 122 and eventually in the cross wall 107.

The tongue 189*a* is automatically placed in the slot 191*b* when the container is closed.

In FIG. 40, a flap 145 is represented which is less high than the side wall 110, with the result that it does not have any lower tongue which could not reach the level of the side edge 166.

Two side tongues could then be forecasted, the tongue 189*a* already described and another one 189*b* on the opposite edge of the flap 145, which must cooperate with a slot 191*c* settled in the triangular flap 127 and eventually in the cross wall 108.

It is obviously possible to combine the different variants which have just been described, for instance in forecasting on a same blocking flap 145 the three tongues 189, 189*a* and 189*b* or in putting on each edge of the flap 145 a number of tongues which differs from zero and one, as well as it is possible to have any other fixing mode of the flaps 144 and 145.

For example, adhesive with long term effect on the flaps 144 and 145 or on the walls 109 and 100 can be forecasted.

In the FIGS. 32 to 36 is represented the case where the adhesive 130 and a protection tape 131 are put according to a segment of a certain length but it may also be a simple limited deposit.

In FIG. 32, the adhesive 130 and the protection tape 131 are forecasted inside the flaps 144 and 145, whereas in FIGS. 33 to 36, the adhesive 130 and the protection tape 131 are forecasted outside the walls 109 and 110.

Independently from the adopted embodiment and from the one represented from FIG. 7 to FIG. 32 regarding the holding upright and/or the closing of the container, blocking flaps 144-145 outside the side walls 109-110 and connected to various holding means can be used.

The presence of the adhesive 130 makes the tongues 188 and 189 as well as the slots 190 and 191 useless and these two possibilities are represented together herein in a purpose of simplification.

This is a high quality to ensure the integrity of the box and of its content.

On the contrary, it can become a hamper for the legitimate recipient of the box when he wants to open it in order to have access to the content.

In order to ease the opening operation, a solid and thin link 195 which is put crosswise and at both ends of which are two V-shaped cuttings which determine two small tongues 196 and 197 (see FIGS. 20 to 22 and 29) is forecasted under the fixing section 142, during the production stage.

When the box is closed, only the tongues 196 and 197 can be seen from the outside, the link 195 being on the hidden side of the section 142 (FIG. 29).

To open the box, the user holds one of both tongues 196 or 197 and imitates the gesture of tearing it up, which has the result of exerting a strong pressure on the link 195, being too solid to tear up, it then follows the tongue to which is was firmly secured and cuts the cardboard sheet making the section 142 in a straight line.

The adhesive 130 always join (as it an irreversible connection) the fixing section 142 and the cross wall 108 but as the section 142 is cut by the opening link 195, it means the cancellation of the section 142 and the user can easily disjoin the box.

This opening means, or the like, can of course be applied to any container in accordance with the invention, whatever the variant chosen, as soon as the container has a closing panel.

In FIGS. 41 to 48, another embodiment of the invention is represented which enables to obtain a very simple container with a reasonable price.

Figure 41:
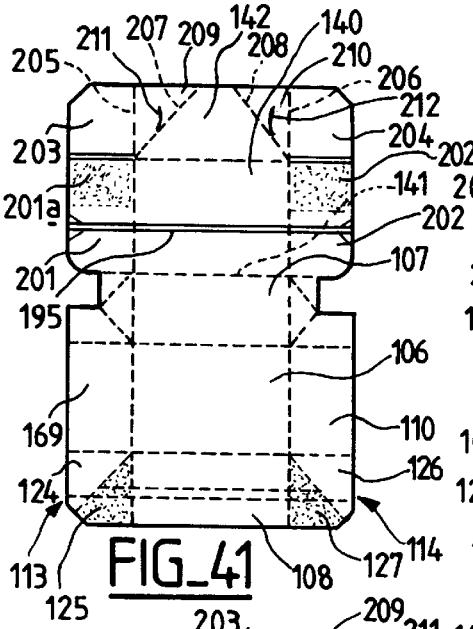

FIG. 41 represents an outline on which are represented always the same elements which provide for the initial creation of a stable part of the container: the bottom 106, two cross walls 107 and 108 and two side walls 109 and 110, as well as the distinct elements 113 and 114 which will not be described once again.

The major difference of this embodiment as regards the previous ones lies in the creation of a lid of a "covering" type.

For so doing, the closing panel 140 is immovably attached to two side flaps 201 and 202 the dimensions of which are slightly equal to those of the side walls 109 and 110 and the fixing section 142 has roughly the same dimension than the cross wall 108.

The said section 142 is immovably attached to two side flaps 203 and 204 determined by folding lines 205 and 206 and presents two oblique folding lines at 45°, 207 and 208.

During the manufacturing of the outline, glue is put on the triangular flaps 125 and 127 of the distinct elements 113 and 114 on the one hand, and on the upper part 201*a*-202*a* of the side flaps 201 and 202 on the other hand.

To make a ready to use blank, the fixing section 142 is folded according to the lines 207 and 208 (left part of FIG. 42) which let two triangular fractions 109 and 210 of the fixing section 142. Then, the set 201, 109 and 113 is flapped towards the middle on the one hand and the set 202, 110 and 114 on the other hand.

Figure 42:
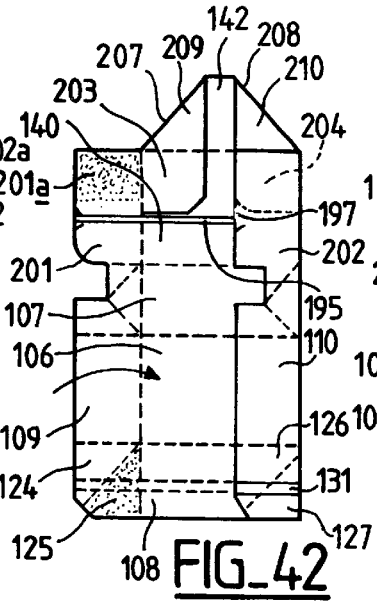

This operation is still to be accomplished on the left side of FIG. 42 and it is already done on the right side.

Thus, the side flaps 203 and 204 are glued to the upper part 201*a*-202*a* of the flaps 201 and 202, and the triangular flaps 125 and 127 are glued to the cross wall 108.

Figure 43:
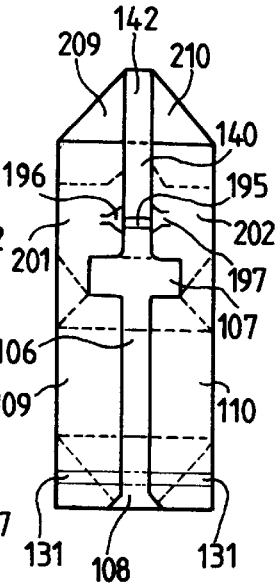
Figure 44:
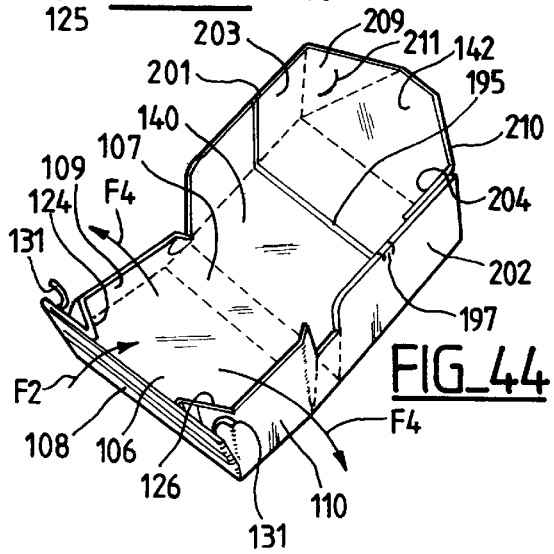

The completed blank is thus as described in FIG. 43.

To use this blank, the protection tapes 131 of the two distinct elements 113 and 114 are removed then the cross wall 108 is set upright to the middle according to arrow F2, whereas the two side walls 109 and 110 are set upright while set aside according to arrows F4, which automatically bring the triangular flaps 124 and 126 against the triangular flaps 125 and 127 which are glued against the wall 108, to which they are connected thanks to the disclosed adhesive 130 and which is secured by tightening the fingers of the flaps 124-126 and the wall 108.

As it has been previously described, a container partly set upright and totally stable in order to fill the objects on the base 106 is obtained.

To complete the container and close it, the protection tape 131 is removed from the wall 108 to disclose the adhesive 130, then the side flaps 201 and 202 are turned aside, which pulls the fixing section 142 in its setting upright and makes the triangular fractions 209 and 210 pivot along the lines 207 and 208 in order to slightly bring the section 142 and its fractions 209 and 210 in the same plane.

Thus, the three sides 201-142-202 of a covering lid connected to the cross wall 107 (FIG. 44) have nearly been set into shape.

Figure 45:
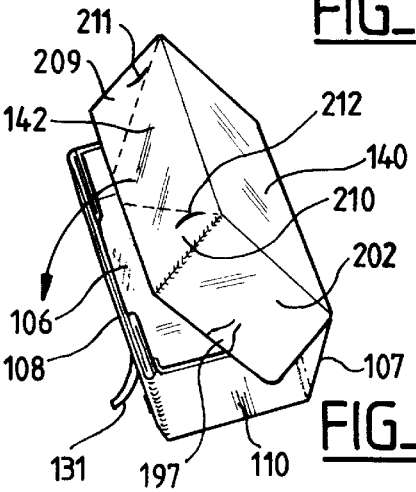

The said wall 107 is set upright and the side flaps 201 and 202 are held to drive them outside the side walls 109 and 110 and at last the section 142 goes in front of the wall 108 up to the covering lid covers this wall 108 and the side walls 109 and 110 (FIG. 45).

The external side of the section 142 is pressed to apply its internal side 142*b* on the adhesive 130.

The one skilled in the art knows that a covering lid needs certain precautions in the accurate shaping of the covered elements against the covering elements so that the lid can be easily settled with the result that the means for so doing will not be described here.

Nevertheless, one of the consequences of such a structure is that the internal side 142*b* of the fixing section 142 misapplies against the external side 148*a* of the cross wall 148.

Figure 46:
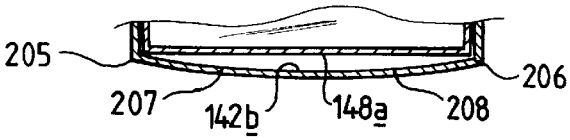

The drawing of FIG. 46 shows here that this phenomenon is all the clearer as these folds 205-206 and 207-208 tend to strain the section 142 in the way of its inflation, i.e. that the "nerve" and the elasticity of the folded cardboard invites the section 142 towards its gauge of the external side 148*a*.

It creates a pressure directed towards the parting of the section 142 by traction perpendicular to the adhesive 130 plane.

In order to prevent such a thing, two slots (at least) 211 and 212 which cross the thickness of the section 142 at a level which corresponds to the one of the adhesive 130 laid on the external side 148*a* are forecasted.

Figure 47:
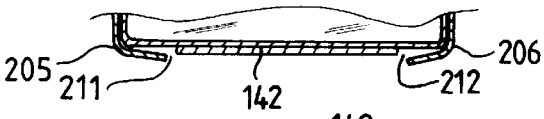
Figure 48:
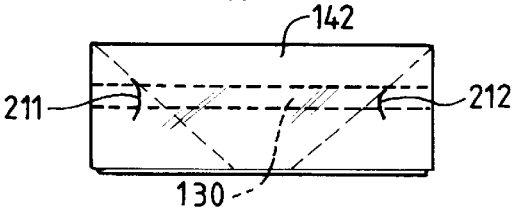

When the outside of the section 142 is cross wise, there is a strong application of its internal side 142*b* against the adhesive 130 and the slots 211 and 212 open by themselves which prevents the effort of the cardboard coming from the folding 205-206 area to be transmitted (FIG. 47).

Figure 49:
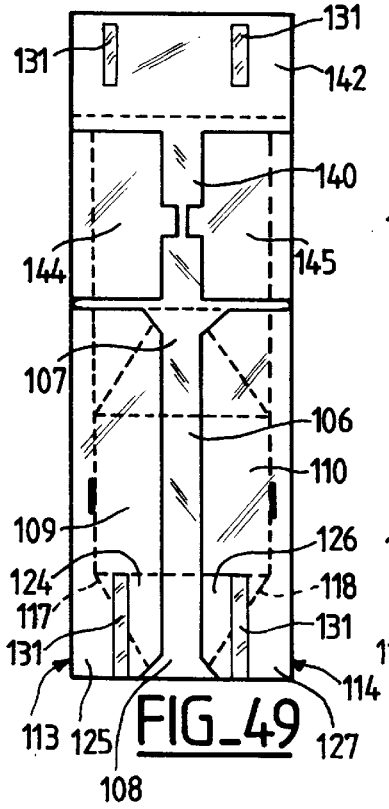

If we now look at FIG. 49, there is a another embodiment of the invention regarding the laying of the adhesive on the distinct elements 113 and 114.

The adhesive 130 and its protection tape 131 as well as the opening link 195 can be applied on the "undulating" machine which makes the corrugated cardboard as from coils of paper.

But during the production of the blanks by plate cuttings, the adhesive 130 and its protection tape 131 as well as eventually the opening link 195 can be also applied either on plates before they are cut or on the outlines or the blanks after they are cut.

For so doing, a specific operation can be forecasted for the setting of the adhesive 130 and its protection tape 131 but it is clear that all the operations should be preferably made on the same so called "folding-gluing" machine.

It may then be difficult to apply the adhesive 130 and its protection tape 131 across the blank, on the cross wall 108 and on the distinct elements 113 and 114 because the folding-gluing machine forces a feeding way of the outline which is lengthwise and not crosswise.

In that case, as it has been represented in FIG. 49, a short segment of adhesive 130 and of protection tape 131 can be applied on each of both distinct elements 113 and 114 after the folding of the outline in the longitudinal way and no longer crosswise with the result that the said segments always cross the folding line 117-118 and extend over the triangular flaps 124-125 and 126-127.

Figure 50:
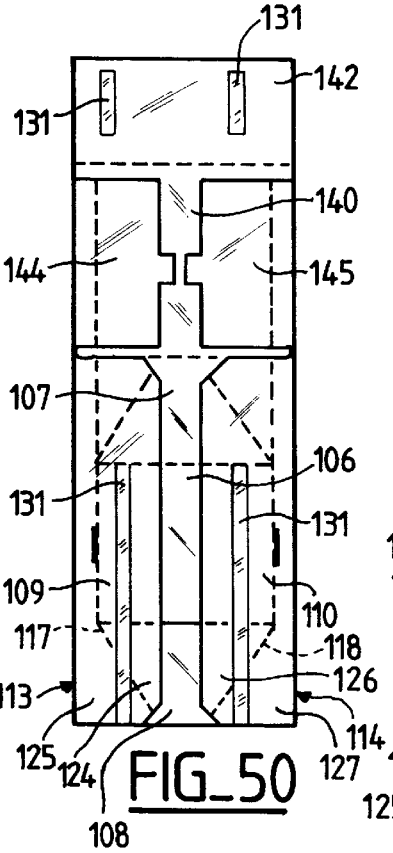

In FIG. 50, the deposit of adhesive on the distinct elements 113 and 114 is used to extend the said deposit on the side walls 109 and 110 which enables, after having removed the protection tape 131 to partly set upright the container on the one hand (wall 108 and side walls 109-110) and, during the closing stage, to fix the blocking flaps 144 and 145 outside and against the walls 109 and 110 on the other hand.

Figure 51:
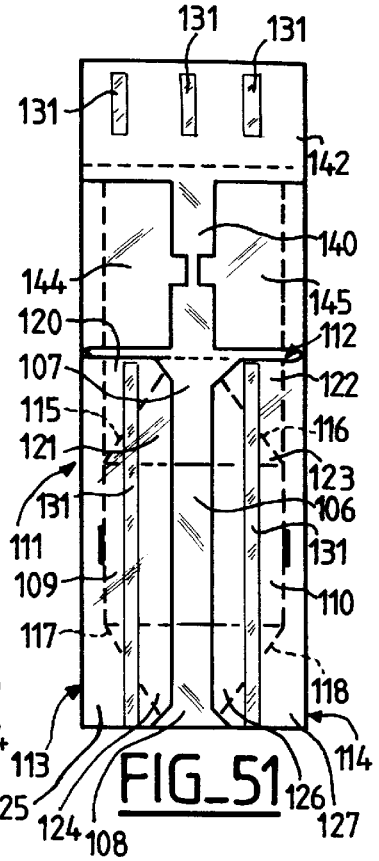
Figure 52:
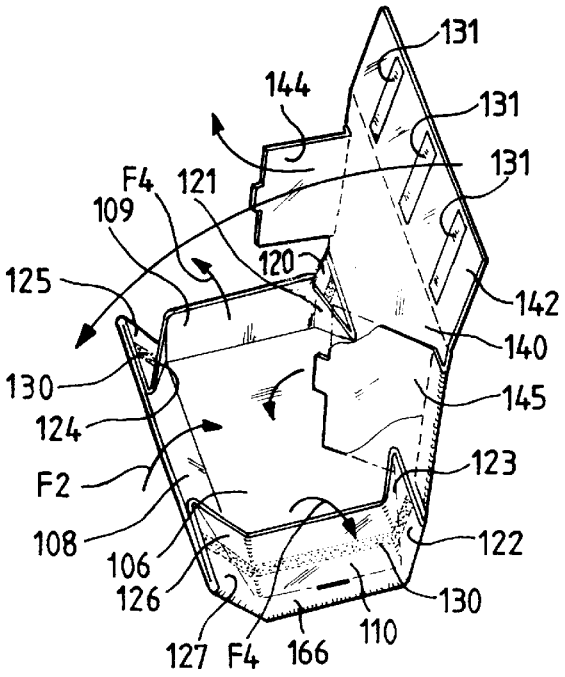
FIG. 52 is a schematic perspective view showing a container in the process of being put into volume and closed, from the blank of FIG. 51.
Figure 53:
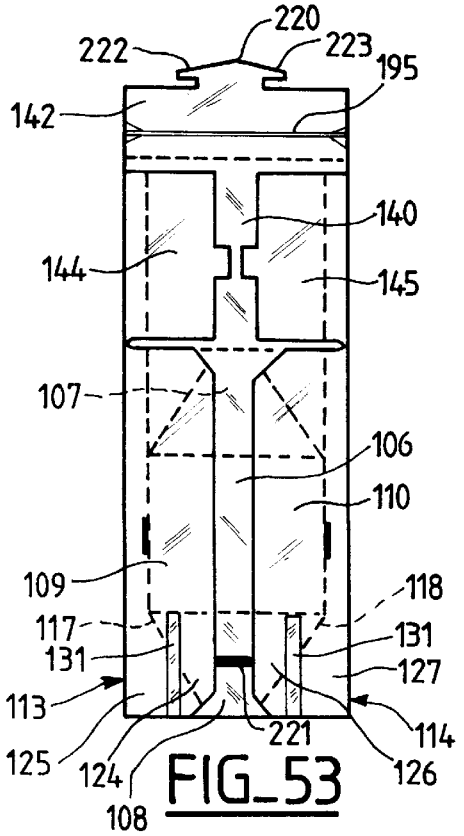
FIG. 53 is a schematic view of a blank in accordance with the invention similar to the one of FIG. 49 but the fixing section of which includes a closing strip which must cooperate with a strip of a cross side and not segments of adhesive.

In FIG. 51, the deposit of adhesive over the walls is used to extend the said deposit over the distinct elements 111 and 112 so as the triangular flaps 120-121 and 122-123 are fixed one against the other in the same way than the triangular flaps of the distinct elements 113 and 114. It can be noticed that the segments of adhesive 130 and of protection tape 131 cross the oblique folding lines 115 and 116 and extend from one edge to the other of the distinct elements 11 and 112 (FIG. 52).

The presence of adhesive on these distinct elements 111 and 112 is not compulsory as they are firmly maintained when the container is closed by the fixing of the section 142 of the panel 140 and the cross wall 107.

But this presence is useful for the comfort of the user and for the solidity of the completed container for it enables to set the container upright thanks to its four walls 107, 108, 109 and 110 while creating a complete and totally stable bowl when the objects to be packed are filled.

Once closed, the container is particularly solid and rigid.

While laying the adhesive on a longitudinal way during the blanks creation, there is a choice between three solutions of FIGS. 49 (distinct elements 113 and 114 only), 50 (distinct elements 113 and 114 as well as walls 109 and 110) and 51-52 (distinct elements 113 and 114, walls 109 and 110, distinct elements 111 and 112).

On the contrary, as there is no adhesive laid crosswise, the closing of the container by the panel 140 and the section 142 cannot be done as previously described.

Looking at FIG. 49, it can be seen that two segments of adhesive 130 and their protection tape 131 have been applied in a longitudinal way over the section 142 in the extension of the segments laid on the distinct elements 113 and 114.

During the closing stage, the protection tapes 131 are removed from the section 142 and the said section is applied on the external side of the cross wall 108.

The fixing to the cross wall 108 is then made in the same way than if the segments 130-131 were crosswise.

In FIGS. 49,50,51 and 52, this solution requesting the adhesive 130 is represented.

The fixing of the section 142 can be forecasted with the only two segments of adhesive 130 and protection tape 131 located in the extension of the two longitudinal segments but it can also be completed by at least another segment as the one visible in FIGS. 51 and 52, slightly in the axis of the container.

The second way consists in forecasting a closing tongue 220 of a know type, immovably attached to the free edge of the fixing section 142 and which must be introduced in a slot 221 created in the cross wall 108.

The closing is made as it has been previously described in reference to the tongue 142*a* and the slot 108*a*, the latter being equivalent to the slot 221.

It is supposed here that there is no adhesive at all for closing the container with the result that solid and safe means must be forecasted.

The tongue 220 is then advantageously provided with two opposed teeth 222 and 223 that are flapped down flat on the tongue 220 before introducing the whole on the slot 221, loosening the fold of the teeth 22 and 223 provoking the return of these latter to their initial position but after having crossed the cardboard by the slot 221 against the internal side of the wall 108.

These arrangements are well known in themselves and do not need more explanations.

With the embodiment of FIGS. 32 to 38, the sections 184 an 185 hold the blank through the pre-folding lines 186 and 187 but the same result could be obtained by using an additional distinct element, independent from the blank.

Figures 54, 55, 56, 57, 58, 59, 60, 61, 62, 63, 64:
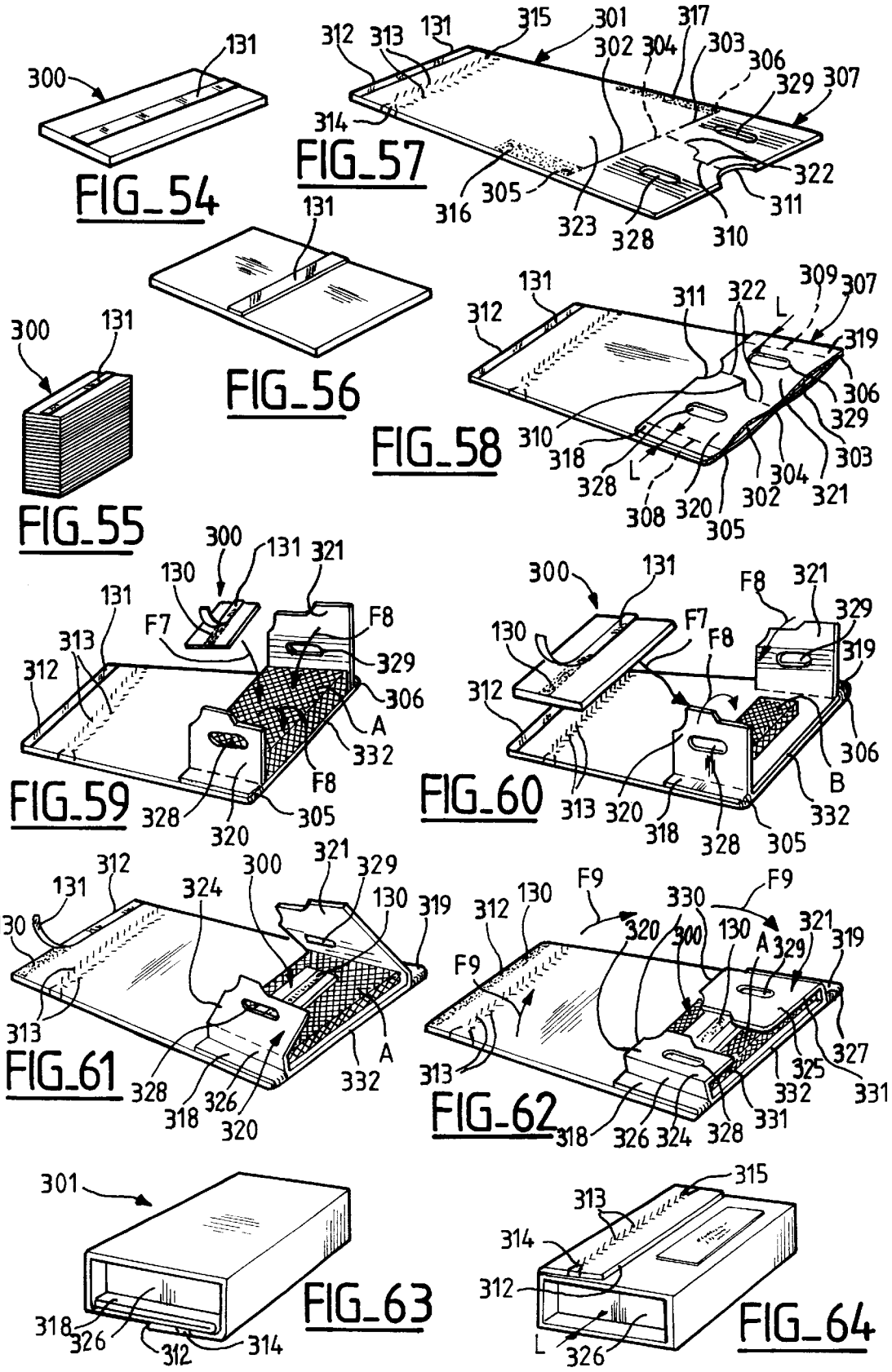
FIGS. 54, 55 and 56 are examples of embodiment of distinct elements separated from the blanks. More precisely.
FIGS. 57 to 74 illustrate different embodiments of the invention for a container with a variable height, adjusted case by case according to the objects to be packed. More particularly.

Taking FIG. 54 as a reference, the said distinct element made under the shape of a simple plate 300 bearing a line of adhesive with long term effect covered with a protection tape 131 can be seen.

When the plate 300 is given a surface corresponding to the one of the cross wall 108, it is placed inside the box, against the triangular flaps 124 and 126 to which the plate 300 is secured thanks to the adhesive with long term effect 130.

It should be noted that it is not necessary for the plate 300 to be also secured to the cross side 108 for it only needs to connect the two triangular flaps 124 and 126.

The immovable attachment of these two flaps has for consequence the holding of the walls 109 and 110 set upright, because the plate 300 prevents them to set aside, which also prevents the triangular flaps 124 and 126 to set aside from the wall 108, with the result that the presence of the adhesive 130 between the triangular flaps is useless.

When the blanks on the one hand and the distinct elements on the other hand are forecasted, they are grouped into two different stocks with the result that at the packaging stage, the user join them in order to create a set in accordance with the invention, the blank and the distinct elements making then an indissociable whole because the distinct elements are irreversibly fixed to the blanks.

The plates 300 can receive adhesive with long term effect either lengthwise (FIGS. 54 and 55) or crosswise (FIG. 56) and, after manufacturing, the plates 300 are joined in a stock as the one illustrated by FIG. 55, then delivered to the customers with or independently from the blanks themselves.

The embodiment of a distinct element under the shape of a plate 300 enables to apply the invention to the containers with a variable height, thanks to which the said height can be adjusted to the one of the objects to be packed so that the said objects can be packed at the nearest to be firmly maintained, immobilized and protected. In FIGS. 57 to 64, the example of a very simple container with a variable height is represented, the outline of which (FIG. 57) is a strip 301 perfectly rectangular which does not create any offcut when it is cut in a plate, provided that the dimensions of the strip and of the plate are properly coordinated.

The strip 301 is marked by two cross pre-folding lines 302 and 303 from one part to the other of a central pre-folding line 304 and between two pre-folding lines 305 and 306, which determines an end panel 307.

The end panel 307 is marked by two side longitudinal pre-folding lines 308 and 309 and a central longitudinal pre-cutting line 310 with a general very long S shape joining the middle of the pre-folding line 304 and the center of a notch 311.

At the end 312 of the strip 301 opposite the panel 307, adhesive with long term effect is laid crosswise and covered with a protection tape 131.

Next to the adhesive 130 and the protection tape 131 are cut, during the manufacturing stage, two symmetric lines of 313 which are laid crosswise and at the two ends of which were created two cuts with a V shape which determine two small tongues 314 and 315.

The outline of FIG. 57 receives glue on two side strips 316 and 317 aimed to receive margins of the panel 307 comprised between the longitudinal edges of the strip 301 and the pre-folding lines 308 and 309, by flapping the panel 307 according to the lines 302-303-304-305-306, which makes the outline of FIG. 42 the ready to use blank of FIG. 58.

The result is that two side edges 318 and 319 of a L width, corresponding to the edges 165 and 166 of the embodiments of FIGS. 20 to 40, are created after flapping the wall 107 during the production stage.

The pre-folding lines and the pre-cutting lines 308,309 and 310 of the panel 107 give birth to two side sections articulated to the edges 318 and 319 and set aside during the packaging step, by the central pre-cutting line 310.

For the sections 320 and 321 not to be accidentally lifted during the handling of the blanks, two "bridges" are forecasted, similar to those 177 of the embodiment of FIGS. 20 to 31.

During the packaging, the user sets the cross sections 320 and 321 upright and breaks the bridges 322, helping himself with the notch 311 to slide his fingers under the sections 320 and 321, which a base 323 recipient of the objects to be packed, made of the part of the strip 301 with extends from the lines 302 to 306 over a length equal to the one of the edges 318-319. The width of the base 323 is equal to the distance setting aside the pre-folding lines 308 and 309.

The user then puts the objects to be packed on the base 323 then puts on them, according to the arrow F7, a distinct element 300 (FIGS. 59 and 60) of which he removed the protection tape 131, then flaps the cross sections 320 and 321, according to the arrows F8, over the distinct element 300, the said sections fixing to the distinct element 300 by the adhesive with long term effect 130.

The sections 320 and 321 automatically fold at the top height of the objects to be packed creating an upper part 324-325 substantially parallel to the plane of the base 323 and a side part 326-327 either perpendicular to the said plane or more or less inclined according to the width of the objects to be packed.

Only the upper parts 324 and 325 must be settled to the distinct element 300 but these parts are more less far from each other according to the height of the objects to be packed since the length of the sections 320 and 321 being complete, it is divided into upper part 324-325 and side part 326-327 depending on the height and the width of the objects to be packed, these measurements being hypothetically variable.

The distinct element 300 tends to cancel the eventual difficulties which arise from unforeseenable differences of dimensions of the objects to be packed since it enables to connect the two upper parts 324 and 325 and then the two sections 320 and 321 as a whole, whatever the of the edges as regards the upper parts 324 and 325.

The consequence of these considerations is that the distinct element 300 can be more or less long according to the height of the objects to be packed and more or less short according to the length of the said objects (we speak of the length even though the said length is measured according to the width of the strip 301).

In order to be sure that all the possible cases are covered, two or more distinct elements 300 of various length can be taken into account.

For the purpose of illustration, a large object to be packed A and a small distinct element 300 have been represented in FIGS. 59,61 and 62, whereas in FIG. 60, a small object to be packed B and a large distinct element 300 have been represented, of similar dimensions than the one of base 323.

In order to ease the proper settlement of the element 300 before the final fixing of the sections 320 and 321, two windows 328 and 329 are cut in the cardboard making the sections 320 and 321, during the manufacturing stage, in order to enable the user to apply a finger on the element 300 through the windows 328 and 329 and to let it slide, if necessary, up to its proper position.

After having flanged the two sections 320 and 321 over the distinct element 300 (FIG. 62), the user has his both hands to complete the container, i.e. to remove the protection tape 131 located at the end 312 of the strip 301 and to bring over the sections 320 and 321 and the objects to be packed, according to the arrows F9, the part of the strip 301 located beyond the base 323 up to its end 312.

This part is automatically folded along the first cross edge 330 of the sections 320 and 321 then along the second cross edge 331 of the said sections, then, at last, along the edge 332 corresponding to the flap line of the end panel 307 over the strip 301.

The user then makes a total wrapping by closing the strip 301 on itself and immobilizes the whole by applying the end of the strip 301 against the external side of the base 323 (FIGS. 63 and 64), the adhesive 130 next to the end 312, formerly disclosed and irreversibly joining the strip 301 and the base 323.

The completed container (FIG. 64) can receive a label in order to be dispatched by the post office.

The recipient opens the container in order to remove the packed objects by holding one tongue 314 or the other 315 and makes the gesture as if he should tear it up, which results in exerting a strong pressure over the fraction of cardboard located between the two lines of drillings 313 which give way in series, thus creating a straight line cut which discloses the strip 301 since its end 312 fixed outside the container stays the only one immovably attached to the base 323.

Taking FIGS. 65 to 74 as references, an embodiment of the invention is shown among many other possible embodiments, according to which the distinct element is immovably attached to the blank.

In these Figures, the same parts bear the same references than the previous ones and their description as well as their use will be repeated only if it is useful for the understanding of the drawings.

In these FIGS. 65 to 74, the outline comprises two parallel strips 401 and 402 connected by a pre-folding line 403 of a flap 404 determined in the strip 401 by this line 404, a second parallel pre-folding line 405 and two cutting lines 406 and 407, the latter being oriented at 45° against the axis of the strip 401.

The said strip 401 is here longer than the strip 402, but in actual practice, according tot he proportions that the blank is given in order to make it compatible with a certain maximum length of the objects to be packed, the strip 401 and 402 can be even or uneven, the one or the other being the longest.

What is important is that the cardboard of the strip 401 is longer than what is simply necessary to make side sections, the distinct element 400 coming, with this embodiment, from this excess of length, so that adhesive with long term effect 130 can be laid on as well as its protection tape 131 but also that the two ends of the strip 401 can overlap, as it will be seen further.

The strip 401 is marked by two pre-folding lines 408 and 409 which determine between themselves a central base recipient of the objects. The rule to be observed in order to determine the length of the strip 401 is that it must be equal to twice the distance which separates the two lines 408 and 409, plus one length more or less important which is the one forecasted to make the distinct element 400 insuring the fixing between themselves of the two ends of the strip 401 beyond the objects to be packed.

The strip 402 is also marked by two pre-folding lines 410 and 411 but set aside as regards the lines 408 and 409, which are only useful if the blank is made of corrugated cardboard, the grooves of this latter are lengthwise against the strip 402.

Both strips 401 and 402 receive the adhesive 130 according to two lines located in their resepctive extension. As a matter of fact, they are one and the same line set in a single time and cut crosswise at the same time than the cutting lines 412 and 413 are created, at each side of the pre-folding line 403, which determine the two strips 401 and 402.

The pre-folding lines 408 and 409 determine between themselves a base 414, recipient of the objects to be packed.

The pre-folding lines 408 and 409 determine between themselves and the cross edges 415 and 416 two sections 417 and 418.

The very simple outline of FIG. 65 is delivered either in the position of this Figure or after superposition of the strips 401 and 402 by direct range according to the line 403, with the result that this outline makes the completed and ready to use blank.

When the user wishes to set the corresponding container into shape, he puts the blank in the position of the FIG. 65, if it is not already like that, then he makes the strip 401 pivot as it is shown in FIGS. 66 and 67 up to the position of FIG. 68.

Both strips 401 and 402 are then equivalent to a blank of the same type than the one described in relation to FIG. 58, i.e. a blank ready to make a container with variable height made of a strip and side sections.

The user sets the sections 417 and 418 upright which fold according the pre-folding lines 408 and 409 which are set aside, as it has been already said, of a distance lower than the width of the strip 402 (FIG. 69).

There are then two edges 420 and 421 remaining of a L width and of the same type than those already described. The user places on the base 414 the objects to be packed, flaps the section 418 and removes the protection tape 131 of the section 417 (FIG. 70).

He then flaps the section 417 over the section 418 which both join thanks to the adhesive 130 (FIG. 71).

It should be noticed that in fact the distinct element 400 is made of the sections 417 and 418 for the important feature is that they conect together.

The determination of the distinct element 400 finally depends on the respective dimensions of the sections 417 and 418 for they need to be assembled whatever the length and the height of the objects to be packed.

The longest section 417 must not have a greater length than the width of the strip 402 in order to be applied on a object to be packed of a low height, or even totally flat.

But it must have a sufficient length, as well as the section 418, for these two sections to be fixed by the adhesive 130 even if the objects to be packed are thick (FIG. 71).

The user ends the container by flapping the upper part (on the drawing) of the strip 402 over the distinct element 400 formed by the cooperation of the two sections 417 and 418 (FIG. 72) then the lower part (on the drawing) of the strip 402 after having removed the protection tape 131 (FIG. 73).

The container is completed when the user firmly applies the end of the strip 402 so that the adhesive 130 be fixed on the other end of the same band 402 (FIGS. 73 and 74).

What is claimed is:

1. A container for receiving items to be packed into an open top of the container that can be closed, comprising:

a blank having a flat initial condition with a polygonal perimeter, the blank being foldable to form a volume having an open position with an open top and a closed position with covered top;

the blank comprising:

a polygonal base;

a plurality of walls each connected to the base at a main pre-folding line so that the walls can be folded into upright positions around base to define the volume with the open top, the walls including at least one cross wall and at least two side walls;

at least two of the main pre-folding lines crossing another one of the main pre-folding lines for defining a pair of distinct elements on opposite sided of the at least one cross walls and outside the base, each of the at least two side walls being connected to a respective one of the distinct elements;

each of the distinct elements including at least two flaps that are separated by a flap pre-folding line positioned so that with the crossing and side walls in their upright positions, the at least two flaps are superimposed on each other with at least one flap also being superimposed on one of the walls;

a closing panel connected at a closing pre-folding line to one of the walls, the closing panel having a size and shape for substantially covering the open top of the volume in the closed position by folding the closing pre-folding line;

a fixing section connected to the closing panel at a fixing pre-folding line which is folded so that the fixing section is superimposed over the at least one cross wall when the volume is in the closed position;

fixing means on one flap of each distinct element for fixing each said one flap against the at least one cross wall when the at least two side walls and the two distinct elements are folded onto the cross wall to form a flat supply position for the blank, a remaining flap of each distinct element being free of the cross wall so that when the walls are moved to the upright positions, the flaps move into their superimposed positions by the folding of the flap pre-folding lines;

at least one long term adhesive line extending along the cross wall and the distinct elements on opposite sides from the fixing means, the adhesive being positioned to adhere the superimposed flaps to each other in the upright positions of the walls, and for adhering the fixing section to the cross wall in the closed position of the volume; and a removable covering on the adhesive line for covering the adhesive line when the blank is in the flat supply position and for being removed when the walls are moved to the upright positions.

2. Container as claimed in claim 1, wherein the adhesive with long term effect (130) being laid through a crosswise line, from one side of the blank to the other and crossing a cross wall (108) and two distinct elements (113 and 114) located from one side of the said cross wall (108) to the other, this line of adhesive is stopped on each of the two distinct elements (113 and 114) located from one side of the cross wall (108) to the other according to a neutral area (180-181) of a length slightly equal to the width of the edge (165-166).

3. Container as claimed in claim 2, wherein the covering is a protection tape (131), the tape (131) also covers the neutral area (180).

4. Container as claimed in claim 2, wherein the covering is a protection tape (131), the tape (131) is away from the neutral area (180).

5. Container as claimed in claim 2, wherein the neutral area (180) is made of a space separated from cardboard of which the blank (101) is made.

6. Container as claimed in claim 1, wherein the blank (101) has distinct elements (111-112-113-114) each located at least at two angles from the base (106) and joining two adjacent walls (108-109, 108-110) at the pre-folding lines (104 and 105), adhesive with long term effect (130) being laid according to two longitudinal lines, each crossing two triangular flaps (125-124, 127-126) of at least one of the distinct element (113 and 114).

7. Container as claimed in claim 6, wherein each of the two longitudinal lines of adhesive with long term effect (130) extends on a distinct element (113-114) and on a side wall (109-110).

8. Container as claimed in claim 7, wherein each of the two longitudinal lines of adhesive with long term effect (130) extends on a distinct element (113-114), on a side wall (109-110) and on a second distinct element (111-112).

9. Container as claimed in claim 1, including at least one blocking section (184-185) which is aimed to hold in ultimate position the two distinct elements (113 and 114) adjacent to a cross wall (108) and which is articulated along an edge of the cross wall (108) in order to be flapped against the distinct elements (113 and 114) when they are in their ultimate position, the adhesive with long term effect (130) being laid either on the blocking section (184-185) or on each of the distinct elements (113-114) for holding the latter in their ultimate position against the cross wall (108).

10. Container as claimed in claim 1, wherein the walls (107, 108, 109 and 110) are directly fixed to the base (106), the corresponding pre-folding line (102-103-104-105) determining an edge of the base (106).

11. Container as claimed in claim 1, wherein the blank (101) has a side edge (165-166) on both sides of the base (106), the opposite side walls (109 and 110) are directly attached to the base (106) through the edge (165-166), the corresponding pre-folding line (104-105) being located beyond a side edge (165-166) of the base (106).

12. Container as claimed in claim 1, wherein the base (106) is immovably attached to a cross wall (107) through a pre-folding line (102), the side wall is immovably attached through a pre-folding line (141) to a closing panel (140) to be flapped over the base (106), over the objects placed on the latter, and the said closing panel (140) is immovably attached, through a pre-folding line (143) to a fixing section (142), means being provided so that the fixing section (142) can cooperate with a second cross wall (108) opposite to the previous one (107) in order to hold the closing panel (140) in its ultimate position.

13. Container as claimed in claim 12, wherein the fixing section (142) has a sufficient length to at least partly cover the external side of the second cross wall (108), the means for the section (142) to cooperate with the second cross wall (108) being made of an adhesive with long term effect (130).

14. Container as claimed in claim 12, wherein the adhesive with long term effect (130) is laid on the fixing section (142).

15. Container as claimed in claim 12, wherein the adhesive with long term effect (130) is laid on the fixing section (142) on to at least two longitudinal segments.

16. Container as claimed in claim 12, wherein the adhesive with long term effect (130) is laid on the cross wall (108).

17. Container as claimed in claim 12, wherein the means for the fixing section (142) to cooperate with the second cross wall (108) are made of a tongue **(142*a*-220) which must enter a slot (108*a*-221)**.

18. Container as claimed in claim 17, wherein the tongue **(142*a*-220) is on the free edge of the fixing section (142) and the slot (108*a*-221) is created in the cross wall (108)**.

19. Container as claimed in claim 17, wherein the tongue (220) has retaining means (222-223).

20. Container as claimed in claim 12, wherein the closing panel (140) has blocking flaps (144 and 145) which must be set upright outside their plane, parallel to the one of the closing panel (140) and which must, after closing of the container, be placed against the two opposite side walls (109 and 110), fixing means **(150-151, 158-159, 188-189, 190-191, 189*a*-189*b*, 191*a*-191*b*, 130) being to hold the blocking flaps (144-145)** in position.

21. Container as claimed in claim 20, wherein the blank (101) has a side edge (165-166) on two opposite sides of the base (106), the corresponding opposite side walls (109 and 110) are fixed to the edge below the sides of the base (106) and the blocking flaps (144 and 145) must be placed outside the side walls (109 and 110).

22. Container as claimed in claim 21, wherein the fixing means are made of adhesive with long term effect (130) laid either on the walls (109 and 110), or on the blocking flaps (114 and 145).

23. Container as claimed in claim 22, wherein the slot (158-159) has two unparalleled longitudinal sides, at least on one part of the length.

24. Container as claimed in claim 20, wherein the fixing means are made of at least one tongue **(188-189-189*a*-189*b*)**

located on a free edge of each blocking flap (144-145) and to enter a corresponding slot (190-191,191*a*-191*b*) located against the wall (109-110).

25. Container as claimed in claim 20, wherein the blocking flaps (144 and 145) are placed inside the side walls (109 and 110), the latter being immovably attached to a flap (150-151) crossed by a slot (158-159) in which a blocking flap (144-145) must be engaged.

26. Container as claimed in claim 25, wherein the blocking flaps (144 and 145) have such a height that their free end (144*a*-145*a*) can be visibly engaged in the corresponding slot (158-159) whereas the closing panel (140) is still far from its closing position.

27. Container as claimed in claim 26, wherein each blocking flap (144-145) has a rectilinear edge (144*b*-145*b*) to be in contact with the rear end (158*b*-159*b*) of the corresponding slot (158-159) which is the nearest of the cross wall (107) to which the closing panel (140) is connected.

28. Container as claimed in claim 20 wherein the blocking flaps (144 and 145) are cut in reinforcements (173-174 and 175-176) applied and fixed against the internal side of the closing panel (140).

29. A container according to claim 1, wherein the base is rectangular, the blank including a further cross wall between the base and the closing panel, each of the flaps of each distinct element being triangular.

30. Container as claimed in claim 29, wherein the triangular flaps are attached by glue.

31. A container according to claim 29, including two pairs of crossing main pre-folding lines which together form said two distinct elements at opposite ends of said first mentioned cross wall and two additional distinct elements at opposite ends of said further cross wall.

32. A container according to claim 1, wherein the covering for the adhesive comprises protective tape, the tape being cut crosswise perpendicular to the main pre-folding line adjacent the cross wall.

* * * * *